US011270637B2

(12) United States Patent
Park et al.

(10) Patent No.: US 11,270,637 B2
(45) **Date of Patent: *Mar. 8, 2022**

(54) DISPLAY DEVICE AND DRIVING METHOD THEREOF

(71) Applicant: Samsung Display Co., Ltd., Yongin-si (KR)

(72) Inventors: Jong Won Park, Asan-si (KR); Seung-Kyu Lee, Asan-si (KR); Hyun Woong Kim, Gwangmyeong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/929,030

(22) Filed: Jul. 14, 2020

(65) Prior Publication Data

US 2020/0342809 A1 Oct. 29, 2020

Related U.S. Application Data

(63) Continuation of application No. 16/255,636, filed on Jan. 23, 2019, now Pat. No. 10,748,482.

(30) Foreign Application Priority Data

Jan. 24, 2018 (KR) ..... KR10-2018-0008775

(51) Int. Cl.
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2300/0819* (2013.01);
(Continued)

(58) Field of Classification Search
CPC ... G09G 2300/0819; G09G 2300/0861; G09G 2320/0209; G09G 2320/0214;
(Continued)

(56) References Cited

U.S. PATENT DOCUMENTS 8,138,997 B2 3/2012 Kim
9,058,774 B2 6/2015 Ahn et al.
(Continued)

FOREIGN PATENT DOCUMENTS

CN 107301831 10/2017
JP 2011-215401 10/2011
(Continued)

OTHER PUBLICATIONS

The Extended European Search Report dated Apr. 24, 2019, issued in European Patent Application No. 19153549.1.
(Continued)

*Primary Examiner* — Hong Zhou
(74) *Attorney, Agent, or Firm* — H.C. Park & Associates, PLC

(57) ABSTRACT

A display device includes: an organic light emitting diode (OLED); a pixel circuit configured to control an amount of a current flowing from a first power voltage to the OLED; and a gate line and a data line that are connected to the pixel circuit, the pixel circuit including: an auxiliary transistor including a gate electrode electrically connected to the data line and a first electrode and a second electrodes connected to the gate line, the first electrode and the second electrode of the auxiliary transistor being electrically connected to each other.

8 Claims, 17 Drawing Sheets

(52) U.S. Cl.
CPC ..... *G09G 2300/0861* (2013.01); *G09G 2320/0209* (2013.01); *G09G 2320/0214* (2013.01); *G09G 2320/0223* (2013.01); *G09G 2320/0233* (2013.01)

(58) Field of Classification Search
CPC ... G09G 2320/0223; G09G 2320/0233; G09G 3/3233; G09G 3/3258
See application file for complete search history.

(56) References Cited

U.S. PATENT DOCUMENTS

| | | | | |
|---|---|---|---|---|
| 9,852,691 | B2 | 12/2017 | Hyun | |
| 10,354,578 | B2 | 7/2019 | Ka et al. | |
| 10,748,482 | B2 * | 8/2020 | Park | G09G 3/3233 |
| 2005/0258775 | A1 | 11/2005 | Ikeda | |
| 2009/0284519 | A1 * | 11/2009 | Kim | G09G 3/3233 345/213 |
| 2014/0375533 | A1 | 12/2014 | Kim | |
| 2015/0084538 | A1 | 3/2015 | Yang et al. | |
| 2015/0170576 | A1 | 6/2015 | Bae | |
| 2016/0035283 | A1 | 2/2016 | Park et al. | |
| 2016/0321994 | A1 | 11/2016 | Lee | |
| 2017/0047004 | A1 | 2/2017 | Yoon et al. | |
| 2017/0053591 | A1 | 2/2017 | Seo et al. | |
| 2017/0287401 | A1 | 10/2017 | Matsui et al. | |

FOREIGN PATENT DOCUMENTS

| | | |
|---|---|---|
| KR | 10-0858618 | 9/2008 |
| KR | 10-2013-0090088 | 8/2013 |
| KR | 10-2016-0089555 | 7/2016 |
| KR | 10-2017-0020595 | 2/2017 |

OTHER PUBLICATIONS

Non-Final Office Action dated Dec. 12, 2019, issued to U.S. Appl. No. 16/255,636.
Notice of Allowance dated Apr. 13, 2020, issued to U.S. Appl. No. 16/255,636.
Chinese Office Action dated Jan. 5, 2022, in Chinese Patent Office for Chinese Patent Application No. 201910067791.2.

* cited by examiner

DISPLAY DEVICE AND DRIVING METHOD THEREOF

CROSS-REFERENCE TO RELATED APPLICATION

This application is a Continuation of U.S. patent application Ser. No. 16/255,636, filed on Jan. 23, 2019, now issued as U.S. Pat. No. 10,748,482, which claims priority to and the benefit of Korean Patent Application No. 10-2018-0008775, filed Jan. 24, 2018, each of which is hereby incorporated by reference for all purposes as if fully set forth herein

BACKGROUND

Field

Exemplary embodiments/implementations of the invention relate generally to a display device and a driving method thereof and, more specifically, to a display device and a driving method thereof that may prevent or reduce crosstalk.

Discussion of the Background

A display device includes a plurality of pixels for displaying an image, a plurality of pixels, and a plurality of gate lines and a plurality of data lines that are connected to the plurality of pixels. The display device sequentially applies a gate signal to the plurality of gate lines, and applies a data voltage corresponding to the gate signal to the plurality of data lines.

The plurality of pixels may include a plurality of transistors, wherein the plurality of transistors have channel capacitance. A time at which each transistor is turned on by applying a gate-on voltage to a gate electrode may be delayed by the channel capacitance. Particularly, when the channel capacitance of a switching transistor, is turned on in response to the gate signal to transmit the data voltage, increases, a time at which the switching transistor is turned on may be delayed, such that the data voltage may not be sufficiently inputted to the pixel. When the data voltage is not sufficiently inputted to the pixel, the pixel may not emit light with desired luminance, and a luminance difference is generated compared with a pixel to which the data voltage is normally inputted. This may cause crosstalk which shows a luminance difference visible on a screen.

The above information disclosed in this Background section is only for understanding of the background of the inventive concepts, and, therefore, it may contain information that does not constitute prior art.

SUMMARY

The Embodiment of the present invention has been made in an effort to provide a display device and a driving method thereof that may prevent or reduce crosstalk.

According to one or more exemplary embodiments, a display device includes: an organic light emitting diode (OLED); a pixel circuit configured to control an amount of a current flowing from a first power voltage to the OLED; and a gate line and a data line that are connected to the pixel circuit, the pixel circuit including: an auxiliary transistor including a gate electrode electrically connected to the data line and a first electrode and a second electrodes connected to the gate line, the first electrode and the second electrode of the auxiliary transistor being electrically connected to each other.

The auxiliary transistor may include: a first auxiliary transistor including a gate electrode directly connected to the data line.

The pixel circuit may further include: a driving transistor configured to control the amount of the current flowing from the first power voltage to the OLED, wherein the auxiliary transistor may include a second auxiliary transistor including a gate electrode to which a compensated data voltage is applied, and wherein the compensated data voltage may refer to a data voltage provided to the data line compensated by a threshold voltage of the driving transistor.

The auxiliary transistor may further include a first auxiliary transistor including a gate electrode directly connected to the data line.

The pixel circuit may further include: a driving transistor configured to control the amount of the current flowing from the first power voltage to the OLED; and a switching transistor configured to transmit a data voltage provided by the data line to the driving transistor, the switching transistor including a drain electrode electrically connected to a source electrode of the driving transistor, wherein the auxiliary transistor may include a third auxiliary transistor including a gate electrode connected between the drain electrode of the switching transistor and the source electrode of the driving transistor.

The auxiliary transistor may further include a first auxiliary transistor including a gate electrode directly connected to the data line.

The auxiliary transistor may further include a second auxiliary transistor including a gate electrode to which a compensated data voltage, and wherein the compensated data voltage may refer to a data voltage provided by the data line compensated by a threshold voltage of the driving transistor.

The auxiliary transistor may further include a first auxiliary transistor including a gate electrode directly connected to the data line.

According to one or more exemplary embodiments, a display device includes: a pixel; and a gate line and a data line connected to the pixel, wherein the pixel may include: a driving transistor including a gate electrode connected to a first node, a first electrode connected to a second node, and a second electrode connected to a third node; a switching transistor including a gate electrode connected to the gate line, a first electrode connected to the data line, and a second electrode connected to the second node; a compensation transistor including a gate electrode connected to the gate line, a first electrode connected to the third node, and a second electrode connected to the first node; an auxiliary transistor including a gate electrode connected to the data line, a first electrode connected to the gate line, and a second electrode connected to the gate line; and an organic light emitting diode (OLED) connected to the third node.

The auxiliary transistor may include a first auxiliary transistor including a gate electrode directly receiving a data voltage applied to the data line.

The auxiliary transistor may include a second auxiliary transistor including a gate electrode connected to the third node.

The auxiliary transistor may further include a first auxiliary transistor including a gate electrode directly receiving a data voltage applied to the data line.

The auxiliary transistor may include a third auxiliary transistor including a gate electrode connected to the second node.

The auxiliary transistor may further include a first auxiliary transistor including a gate electrode directly receiving a data voltage applied to the data line.

The auxiliary transistor may further include a second auxiliary transistor including a gate electrode connected to the third node.

The auxiliary transistor may further include a first auxiliary transistor configured to include a gate electrode directly receiving a data voltage applied to the data line.

According to one or more exemplary embodiments, a driving method of a display device includes: a driving transistor configured to control an amount of a current flowing from a first power voltage to an organic light emitting diode (OLED), a switching transistor configured to transmit a data voltage applied to a data line to the driving transistor in response to a gate signal applied from a gate line to a gate electrode of the switching transistor, a compensation transistor configured to diode-connect the driving transistor in response to the gate signal applied to a gate electrode of the compensation transistor, and an auxiliary transistor including a gate electrode connected to the data line and a first electrode and a second electrode connected to the gate line, the driving method including: turning on the switching transistor and the compensation transistor by applying the gate signal having a gate-on voltage; and offsetting, by applying the gate signal having the gate-on voltage to a gate electrode of the auxiliary transistor, channel capacitance of the switching transistor and the compensation transistor.

The data voltage applied to the data line may be directly applied to a gate electrode of the auxiliary transistor.

A data voltage in which a threshold voltage of the driving transistor is compensated may be applied to the gate electrode of the auxiliary transistor.

The data voltage may be applied to the gate electrode of the auxiliary transistor through the switching transistor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
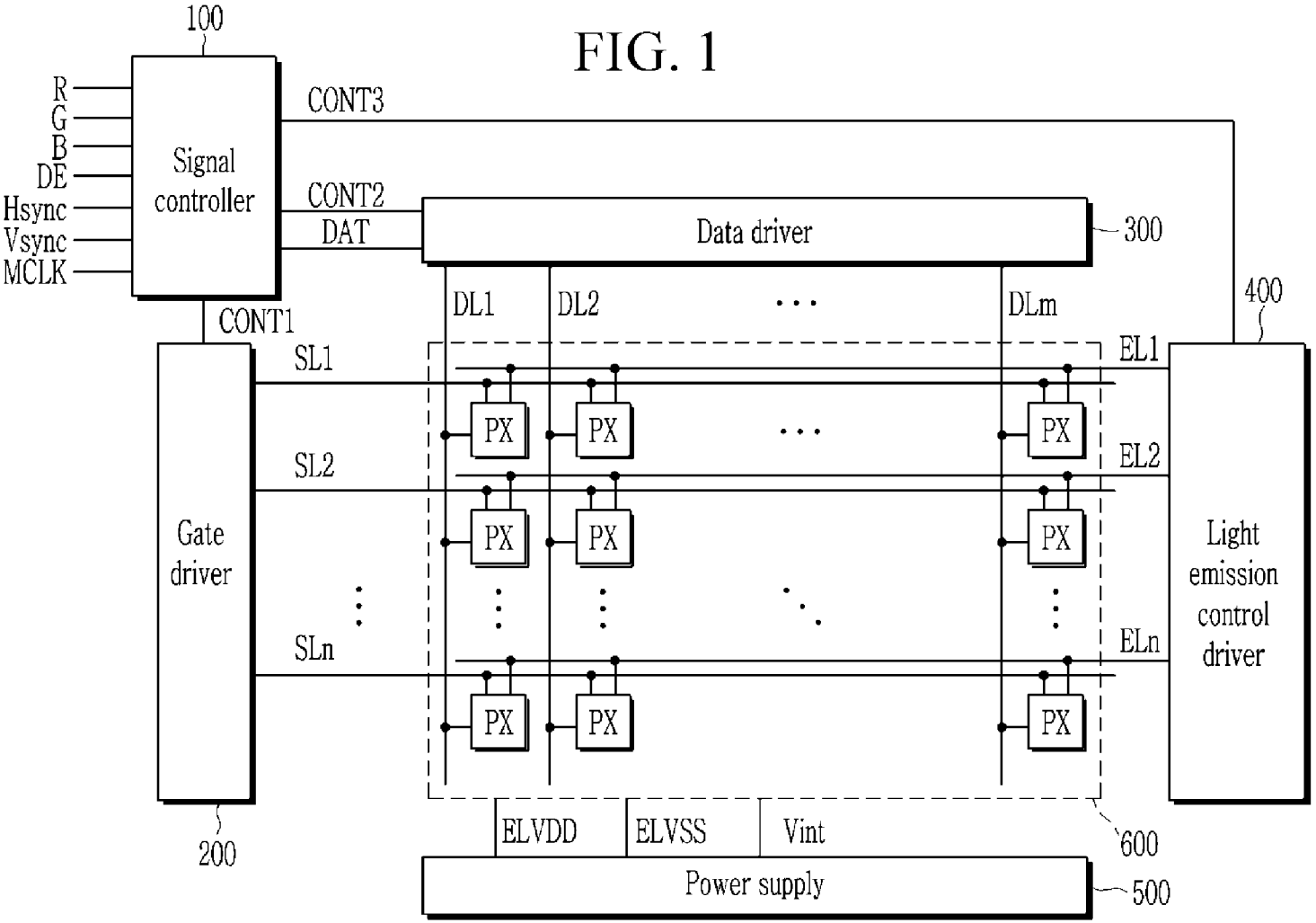
FIG. 1 illustrates a block diagram of a display device according to an exemplary embodiment.

In the following description, for the purposes of explanation, numerous specific details are set forth in order to provide a thorough understanding of various exemplary embodiments or implementations of implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

The Embodiment of the present disclosure will be described more fully hereinafter with reference to the accompanying drawings, in which exemplary embodiments of the invention are shown. As those skilled in the art would realize, the described embodiments may be modified in various different ways, all without departing from the spirit or scope.

Parts that are irrelevant to the description will be omitted to clearly describe the present disclosure, and like reference numerals designate like elements throughout the specification.

Hereinafter, a display device according to an exemplary embodiment will be described with reference to FIG. 1.

FIG. 1 illustrates a block diagram of a display device according to an exemplary embodiment.

Referring to FIG. 1, a display device includes a signal controller 100, a gate driver 200, a data driver 300, a light emission control driver 400, a power supply 500, and a display unit 600.

The signal controller 100 receives image signals R, G, and B from an external device, and an input control signal for controlling the display thereof. The image signals R, G, and B includes luminance information for each pixel PX, and the luminance includes a predetermined number of gray levels. The input control signal, for example, includes a data enable signal DE, a horizontal synchronization signal Hsync, a vertical synchronization signal Vsync, a main clock signal MCLK, etc.

Based on the input image signals R, G, and B and the input control signal received, the signal controller 100 appropriately adjusts the input image signals R, G, and B according to operating conditions of the display unit 600 and the data driver 300, and generates a first control signal CONT1, a second control signal CONT2, an image data signal DAT, and a third control signal CONT3. The signal controller 100 transmits the first control signal CONT1 to the gate driver 200, transmits the second control signal CONT2 and the image data signal DAT to the data driver 300, and transmits the third control signal CONT3 to the light emission control driver 400.

The display unit 600 includes a plurality of gate lines (SL1-SLn), a plurality of data lines (DL1-DLm), a plurality of emission control lines (EL1-ELn), and a plurality of pixels PX. The plurality of pixels PX may be connected to the plurality of gate lines (SL1-SLn), the plurality of data lines (DL1-DLm), and the plurality of emission control lines (EL1-ELn) to be substantially arranged in a matrix form. The plurality of gate lines (SL1-SLn) substantially extend in a row direction to be substantially parallel to each other. The plurality of emission control lines (EL1-ELn) substantially extend in a row direction to be substantially parallel to each other. The plurality of data lines (DL1-DLm) substantially extend in a row direction to be substantially parallel to each other.

The gate driver 200 is connected to the plurality of gate lines (SL1-SLn), and applies a gate signal including a gate-on voltage and a gate-off voltage according to the first control signal CONT1 to the plurality of gate lines (SL1-SLn). The gate driver 200 may sequentially apply a gate signal of the gate-on voltage to the plurality of gate lines (SL1-SLn).

The data driver 300 is connected to the plurality of data lines (DL1-DLm), samples and holds the image data signal DAT according to the second control signal CONT2, and applies a data voltage to the plurality of data lines (DL1-DLm). The data driver 300 may apply a data signal having a predetermined voltage range to the plurality of data lines (DL1-DLm) corresponding to the gate signal of the gate-on voltage.

The light emission control driver 400 may be connected to the plurality of emission control lines (EL1-ELn), and may apply an emission control signal including a gate-on voltage and a gate-off voltage to the plurality of emission control lines (EL1-ELn) according to the third control signal CONT3.

The power supply 500 provides a first power voltage ELVDD, a second power voltage ELVSS, and an initialization voltage Vint to the plurality of pixels PX. The first power voltage ELVDD may be a high level voltage provided to an anode electrode of an organic light emitting diode (OLED) included in each of the plurality of pixels PX. The second power voltage ELVSS may be a low level voltage provided to a cathode electrode of an organic light emitting diode (OLED) included in each of the plurality of pixels PX. The first power voltage ELVDD and the second power voltage ELVSS are driving voltages for causing the plurality of pixels PX to emit light.

In exemplary embodiments, the signal controller 100, the gate driver 200, the data driver 300, the light emission control driver 400, the power supply 500, and/or one or more components thereof, may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

According to one or more exemplary embodiments, the features, functions, processes, etc., described herein may be implemented via software, hardware (e.g., general processor, digital signal processing (DSP) chip, an application specific integrated circuit (ASIC), field programmable gate arrays (FPGAs), etc.), firmware, or a combination thereof. In this manner, the signal controller 100, the gate driver 200, the data driver 300, the light emission control driver 400, the power supply 500, and/or one or more components thereof may include or otherwise be associated with one or more memories (not shown) including code (e.g., instructions) configured to cause the signal controller 100, the gate driver 200, the data driver 300, the light emission control driver 400, the power supply 500, and/or one or more components thereof to perform one or more of the features, functions, processes, etc., described herein.

The memories may be any medium that participates in providing code to the one or more software, hardware, and/or firmware components for execution. Such memories may be implemented in any suitable form, including, but not limited to, non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a compact disk-read only memory (CD-ROM), a rewriteable compact disk (CD-RW), a digital video disk (DVD), a rewriteable DVD (DVD-RW), any other optical medium, punch cards, paper tape, optical mark sheets, any other physical medium with patterns of holes or other optically recognizable indicia, a random-access memory (RAM), a programmable read only memory (PROM), and erasable programmable read only memory (EPROM), a FLASH-EPROM, any other memory chip or cartridge, a carrier wave, or any other medium from which information may be read by, for example, a controller/processor.

Hereinafter, a pixel according to an exemplary embodiment will be described with reference to FIG. 2, and channel capacitance with respect to a gate-source voltage difference of a transistor will be described with reference to FIG. 3.

Figure 2:
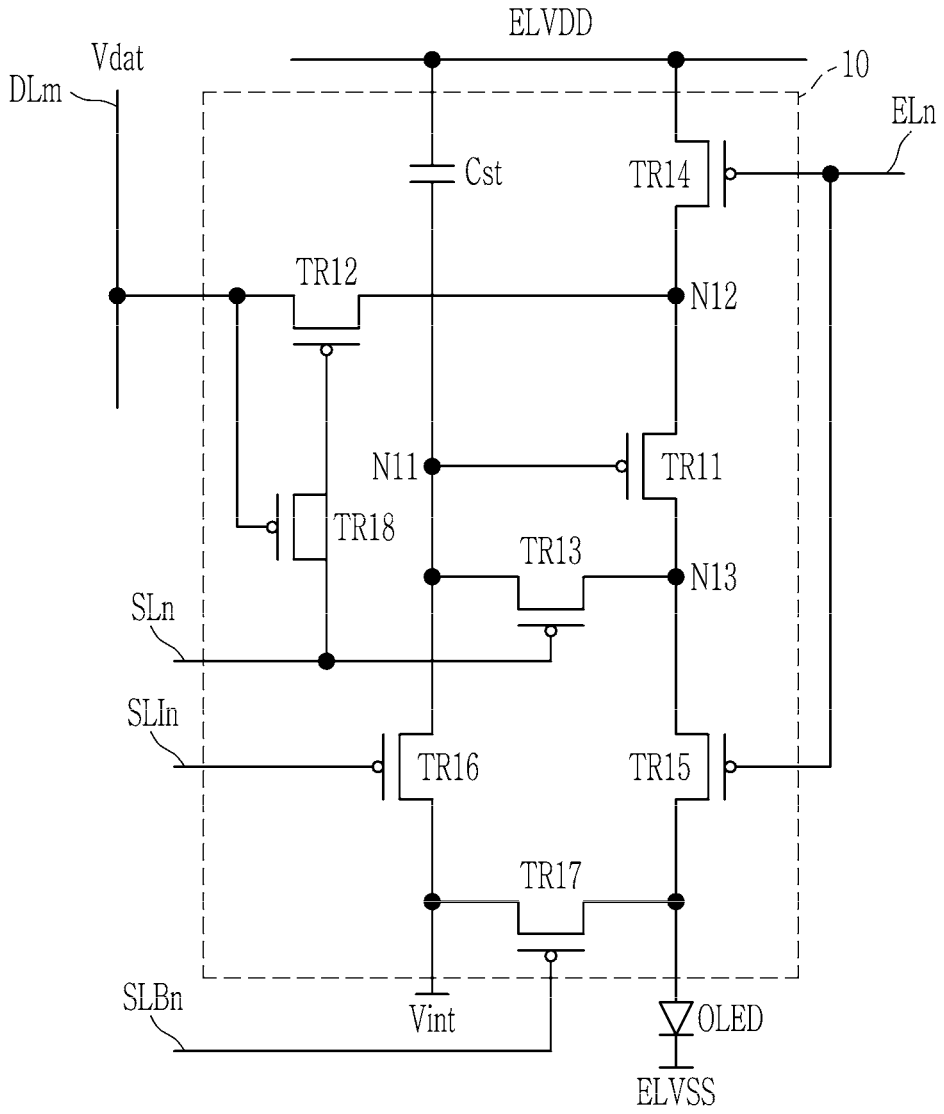
FIG. 2 illustrates a pixel according to an exemplary embodiment.

FIG. 2 illustrates a pixel including a pixel circuit 10 according to an exemplary embodiment. A pixel PX is an exemplary pixel positioned at an n-th pixel row and an m-th pixel column among the plurality of pixels PX included in the display device of FIG. 1.

Referring to FIG. 2, the pixel PX includes the organic light emitting diode (OLED) and the pixel circuit 10 for controlling a current flowing to the organic light emitting diode (OLED) from the first power voltage ELVDD. A first gate line SLn, a second gate line SLIn, a third gate line SLBn, a data line DLm, and an emission control line ELn may be connected to the pixel circuit 10. The second gate line SLIn may be a gate line positioned one pixel row before the first gate line SLn. For example, the second gate line SLIn may be connected to a gate line SLn−1 of a pixel on a previous row, which is the n−1 row. The third gate line SLBn may be a gate line positioned one pixel row before the second gate line SLIn, a gate line positioned at the same pixel row as the second gate line SLIn, or a gate line positioned at the same pixel row as the first gate line SLn. For example, the third gate line SLBn may be connected to a gate line SLn−2 of a pixel on the n−2 row, a gate line SLn−1 of a pixel on the n−1 row, or the first gate line SLn.

The pixel circuit 10 may include a driving transistor TR11, a switching transistor TR12, a compensation transistor TR13, a first emission control transistor TR14, a second emission control transistor TR15, an initialization transistor TR16, a reset transistor TR17, a first auxiliary transistor TR18, and a storage capacitor Cst.

The driving transistor TR11 includes a gate electrode connected to a first node N11, a first electrode connected to a second node N12, and a second electrode connected to a third node N13. The driving transistor TR11 is connected between the first power voltage ELVDD and the organic light emitting diode (OLED), and controls an amount of current flowing from the first power voltage ELVDD to the organic light emitting diode (OLED) corresponding to a voltage of the first node N11.

The switching transistor TR12 includes a gate electrode connected to a first gate line SLn, a first electrode connected to a data line DLm, and a second electrode connected to the second node N12. The switching transistor TR12 is connected between the data line DLm and the driving transistor TR11, and is turned on depending on a first gate signal of a gate-on voltage applied to the first gate line SLn to transmit a data voltage Vdat applied to the data line DLm to the second node N12.

The compensation transistor TR13 includes a gate electrode connected to the first gate line SLn, a first electrode connected to the third node N13, and a second electrode connected to the first node N11. The compensation transistor TR13 is connected between a second electrode and a gate electrode of the driving transistor TR11, and is turned on depending on the first gate signal of the gate-on voltage applied to the first gate line SLn. The compensation transistor TR13 diode-connects the driving transistor TR11, thereby compensating a threshold voltage of the driving transistor TR11. Hereinafter, the threshold voltage of the driving transistor TR11 is referred to as Vth. A compensated data voltage (Vdat+Vth), which is the data voltage Vdat compensated by the threshold voltage Vth of the driving transistor TR11, is transmitted to the first node N11.

The first emission control transistor TR14 includes a gate electrode connected to an emission control line ELn, a first electrode connected to the first power voltage ELVDD, and a second electrode connected to the second node N12. The first emission control transistor TR14 is connected between the first power voltage ELVDD and the driving transistor TR11, and is turned on depending on the emission control signal of the gate-on voltage applied to the emission control line ELn to transmit the first power voltage ELVDD to the driving transistor TR11.

The second emission control transistor TR15 includes a gate electrode connected to the emission control line ELn, a first electrode connected to the third node N13, and a second electrode connected to the anode of the organic light emitting diode (OLED). The second emission control transistor TR15 is connected between the driving transistor TR11 and the organic light emitting diode (OLED), and is turned on depending on the emission control signal of the gate-on voltage applied to the emission control line ELn to transmit a current flowing through the driving transistor TR11 to the organic light emitting diode (OLED).

The initialization transistor TR16 includes a gate electrode connected to a second gate line SLIn, a first electrode connected to the initialization voltage Vint, and a second electrode connected to the first node N11. The initialization transistor TR16 is connected between the gate electrode of the driving transistor TR11 and the initialization voltage Vint, and is turned on depending on a second gate signal of a gate-on voltage applied to the second gate line SLIn. The initialization transistor TR16 may transmit the initialization voltage Vint to the first node N11, thereby initializing the gate voltage of the driving transistor TR11 to the initialization voltage Vint.

The reset transistor TR17 includes a gate electrode connected to the third gate line SLBn, a first electrode connected to the initialization voltage Vint, and a second electrode connected to the anode of the organic light emitting diode (OLED). The reset transistor TR17 is connected between the anode of the organic light emitting diode (OLED) and the initialization voltage Vint, and is turned on depending on a third gate signal of the gate-on voltage applied to the third gate line SLBn. The reset transistor TR17 transmits the initialization voltage Vint to the anode of the organic light emitting diode (OLED), thereby resetting the organic light emitting diode (OLED) to the initialization voltage Vint. In some exemplary embodiments, the reset transistor TR17 may be omitted.

The first auxiliary transistor TR18 includes a gate electrode connected to the data line DLm, a first electrode connected to the first gate line SLn, and a second electrode connected to the first gate line SLn. A gate electrode of the first auxiliary transistor TR18 may be directly connected to the data line DLm without passing through other elements of the pixel circuit 10. That is, the data voltage Vdat may be directly applied to the gate electrode of the first auxiliary transistor TR18. The first auxiliary transistor TR18 may operate as a metal oxide semiconductor (MOS) capacitor in which the first and second electrodes are electrically connected to each other. That is, when the data voltage Vdat, which is low enough to form a channel in a semiconductor layer, is supplied to the gate electrode, the first auxiliary transistor TR18 may operate as one capacitor in which the semiconductor layer and the gate electrode with a gate insulating layer therebetween has predetermined capacitance.

The driving transistor TR11, the switching transistor TR12, the compensation transistor TR13, the first emission control transistor TR14, the second emission control transistor TR15, the initialization transistor TR16, the reset transistor TR17, and the first auxiliary transistor TR18 may be p-channel field effect transistors. A gate-on voltage for turning on the p-channel field effect transistor is a low level voltage, and a gate-off voltage for turning it off is a high level voltage.

In some exemplary embodiments, at least one of the driving transistor TR11, the switching transistor TR12, the compensation transistor TR13, the first emission control transistor TR14, the second emission control transistor TR15, the initialization transistor TR16, the reset transistor TR17, and the first auxiliary transistor TR18 may be an n-channel field effect transistor. Then, a gate-on voltage for turning on the n-channel field effect transistor is a high level voltage, and a gate-off voltage for turning it off is a low level voltage.

The storage capacitor Cst includes a first electrode connected to the first power voltage ELVDD and a second electrode connected to the first node N11. The compensated data voltage (Vdat+Vth), which is the data voltage Vdat compensated by the threshold voltage Vth of the driving transistor TR11, is applied to the first node N11, and the storage capacitor Cst serves to maintain the compensated data voltage (Vdat+Vth) of the first node N11.

The organic light emitting diode (OLED) includes the anode connected to the second electrode of the second emission control transistor TR15 and the cathode connected to the second power voltage ELVSS. The organic light emitting diode (OLED) may be connected between the pixel circuit 10 and the second power voltage ELVSS to emit light with a luminance corresponding to a current provided from the pixel circuit 10. The organic light emitting diode (OLED) may include an emission layer including an organic light emission material. Holes and electrons are injected into the emission layer from the anode electrode and the cathode electrode, respectively, and light is emitted when excitons formed by the injected holes and electrons fall from an excited state to a ground state. The organic light emitting diode (OLED) may emit light of one of primary colors, or white light. The primary colors may be three primary colors such as red, green, and blue. Alternatively, the primary colors may be yellow, cyan, magenta, etc.

The channel capacitance of the transistor may be varied by the gate-source voltage difference Vgs. This will now be described with reference to FIG. 3.

Figure 3:
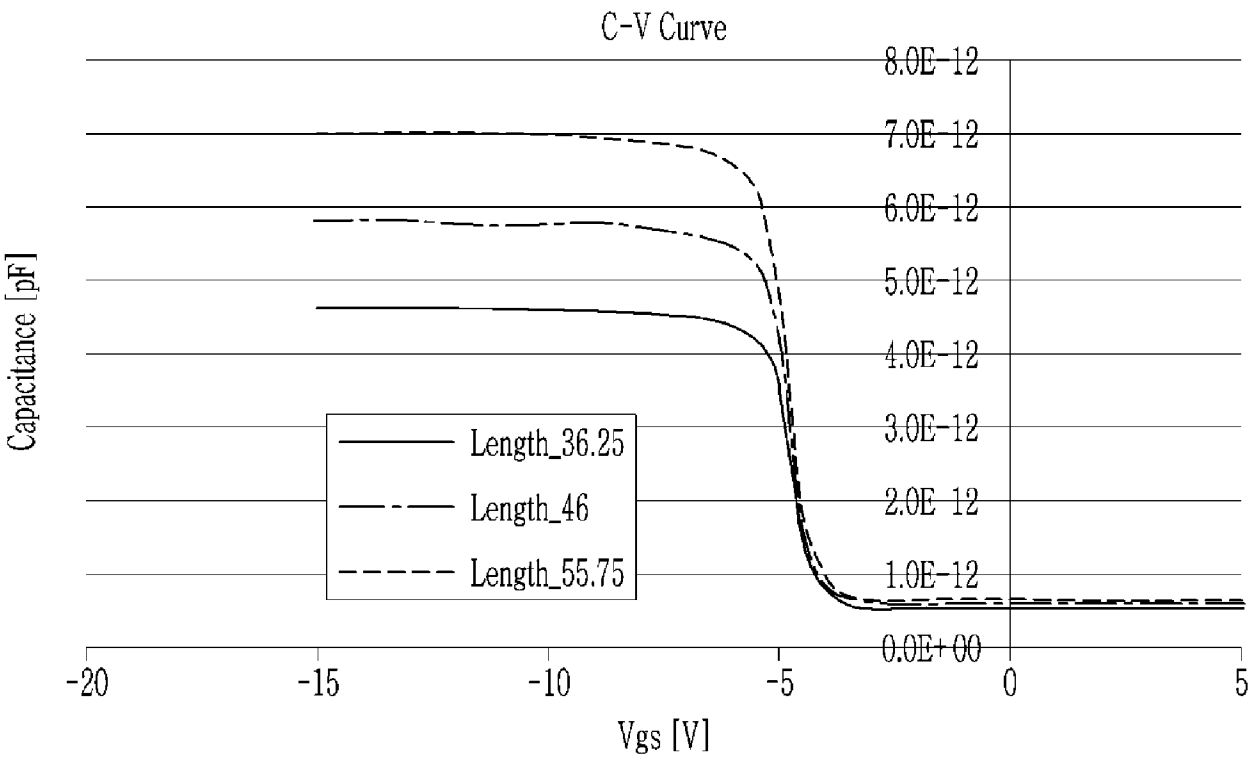
FIG. 3 illustrates a graph of channel capacitance with respect to a gate-source voltage difference of a transistor.

FIG. 3 illustrates a graph of channel capacitance with respect to a gate-source voltage difference of a transistor. FIG. 3 shows a result of measuring channel capacitance for gate-source voltage differences (Vgs) of three p-channel field effect transistors with channels of different lengths.

Referring to FIG. 3, in a case of the p-channel field effect transistor, it can be seen that the gate-source voltage difference (Vgs) is negative and the channel capacitance is increased as the gate-source voltage difference (Vgs) is smaller.

Referring back to FIG. 2, a channel capacitance difference in the switching transistor TR12 may occur depending on a level of the data voltage Vdat applied to the data line DLm. In addition, a channel capacitance difference in the compensation transistor TR13 may occur depending on a level of the data voltage Vdat. A level of a data voltage (hereinafter referred to as a black data voltage) corresponding to black luminance is greater than that of a data voltage (hereinafter referred to as a gray data voltage) corresponding to gray luminance. A gate-source voltage difference Vgs of the switching transistor TR12 when the black data voltage is applied to the data line DLm is smaller than a gate-source voltage difference Vgs of the switching transistor TR12 when the gray data voltage is applied to the data line DLm. In addition, a gate-source voltage difference Vgs of the compensation transistor TR13 when the black data voltage is applied to the data line DLm is smaller than a gate-source voltage difference Vgs of the compensation transistor TR13 when the gray data voltage is applied to the data line DLm. Accordingly, the channel capacitance of the switching transistor TR12 when the black data voltage is applied to the data line DLm becomes greater than the channel capacitance of the switching transistor TR12 when the gray data voltage is applied to the data line DLm. In addition, the channel capacitance of the compensation transistor TR13 when the black data voltage is applied to the data line DLm becomes greater than the channel capacitance of the compensation transistor TR13 when the gray data voltage is applied to the data line DLm. When the black data voltage is applied to the data line DLm, as the channel capacitance of the switching transistor TR12 and the compensation transistor TR13 is increased, a load of the first gate signal applied to the first gate line SLn for turning on the switching transistor TR12 and the compensation transistor TR13 may be further increased. The first auxiliary transistor TR18 serves to reduce such a load.

An operation in which the first auxiliary transistor TR18 serves to reduce the load of the switching transistor TR12 and the compensation transistor TR13 will now be described with reference to Table 1.

TABLE 1

| | Black | | | Gray | | |
|---|---|---|---|---|---|---|
| | TR12 | TR13 | TR18 | TR12 | TR13 | TR18 |
| Vg | −8 V | −8 V | 6 V | −8 V | −8 V | 4 V |
| Vs (Vd) | 6 V | 3 V | −8 V | 4 V | 1 V | −8 V |
| Vgs | −14 V | −11 V | 14 V | −12 V | −9 V | 12 V |

In Table 1, a case in which the gate-on voltage of the first gate signal applied to the first gate line SLn is −8 V, the threshold voltage Vth of the driving transistor TR11 is −3 V, the black data voltage is 6 V, and the gray data voltage is 4 V will be exemplarily described.

When the black data voltage is applied to the data line DLm, the gate voltage Vg of the switching transistor TR12 is −8 V, the source voltage Vs (which is the same as the drain voltage Vd) is 6 V, and the gate-source voltage difference Vgs is −14 V. The gate voltage Vg of the compensation transistor TR13 is −8 V, the source voltage Vs is 3 V as the compensated data voltage (Vdat+Vth) in which the threshold voltage Vth of the driving transistor TR11 is compensated to the data voltage Vdat, and the gate-source voltage difference Vgs is −11 V. The gate voltage Vg of the first auxiliary transistor TR18 is 6 V, the source voltage Vs is −8 V, and the gate-source voltage difference Vgs is 14 V.

When the gray data voltage is applied to the data line DLm, the gate voltage Vg of the switching transistor TR12 is −8 V, the source voltage Vs is 4 V, and the gate-source voltage difference Vgs is −12 V. The gate voltage Vg of the compensation transistor TR13 is −8 V, the source voltage Vs is 1 V as the compensated data voltage (Vdat+Vth) in which the threshold voltage Vth of the driving transistor TR11 is compensated to the data voltage Vdat, and the gate-source voltage difference Vgs is −9 V. The gate voltage Vg of the first auxiliary transistor TR18 is 4 V, the source voltage Vs is −8 V, and the gate-source voltage difference Vgs is 12 V.

Compared with the case in which the gray data voltage is applied to the data line DLm, when the black data voltage is applied thereto, the gate-source voltage differences Vgs of the switching transistor TR12 and the compensation transistor TR13 are respectively reduced by 2 V, thus the channel capacitance of the switching transistor TR12 and the compensating transistor TR13 is increased. Alternatively, the gate-source voltage difference Vgs of the first auxiliary transistor TR18 is increased by 2 V, thus the channel capacitance of the first auxiliary transistor TR18 is reduced. Since the first auxiliary transistor TR18 is connected to the same first gate line SLn as the switching transistor TR12 and the compensation transistor TR13, the reduced channel capacitance of the first auxiliary transistor TR18 may offset the increased channel capacitance of the switching transistor TR12 and the compensating transistor TR13. That is, the first auxiliary transistor TR18 may reduce the load of the first gate signal applied to the first gate line SLn.

According to a comparable embodiment in which the pixel PX does not include the first auxiliary transistor TR18, when the black data voltage is inputted to the pixel PX, a time during which the gate signal transits from the gate-off voltage to the gate-on voltage may be delayed due to the channel capacitance of the switching transistor TR12 and the compensation transistor TR13. Thus, the black data voltage is not sufficiently inputted to the pixel PX, so that the pixel PX may emit light with brighter luminance than black luminance, which may be viewed as crosstalk.

According to the exemplary embodiment, as described in detail with reference to FIG. 2, since the pixel PX includes the first auxiliary transistor TR18 that may offset the increased channel capacitance of the switching transistor TR12 and the compensation transistor TR13, the load of the first gate signal may be reduced, thereby preventing or reducing crosstalk from being generated.

Hereinafter, pixels according to other exemplary embodiments will be described with reference to FIGS. 4, 5, 6, 7, 8, 9, 10, 11, 12, 13, 14, 15, and 16. Compared with the exemplary embodiments illustrated in FIGS. 1, 2, and 3, differences will be mainly described, and a duplicate description thereof will be omitted.

Figure 4:
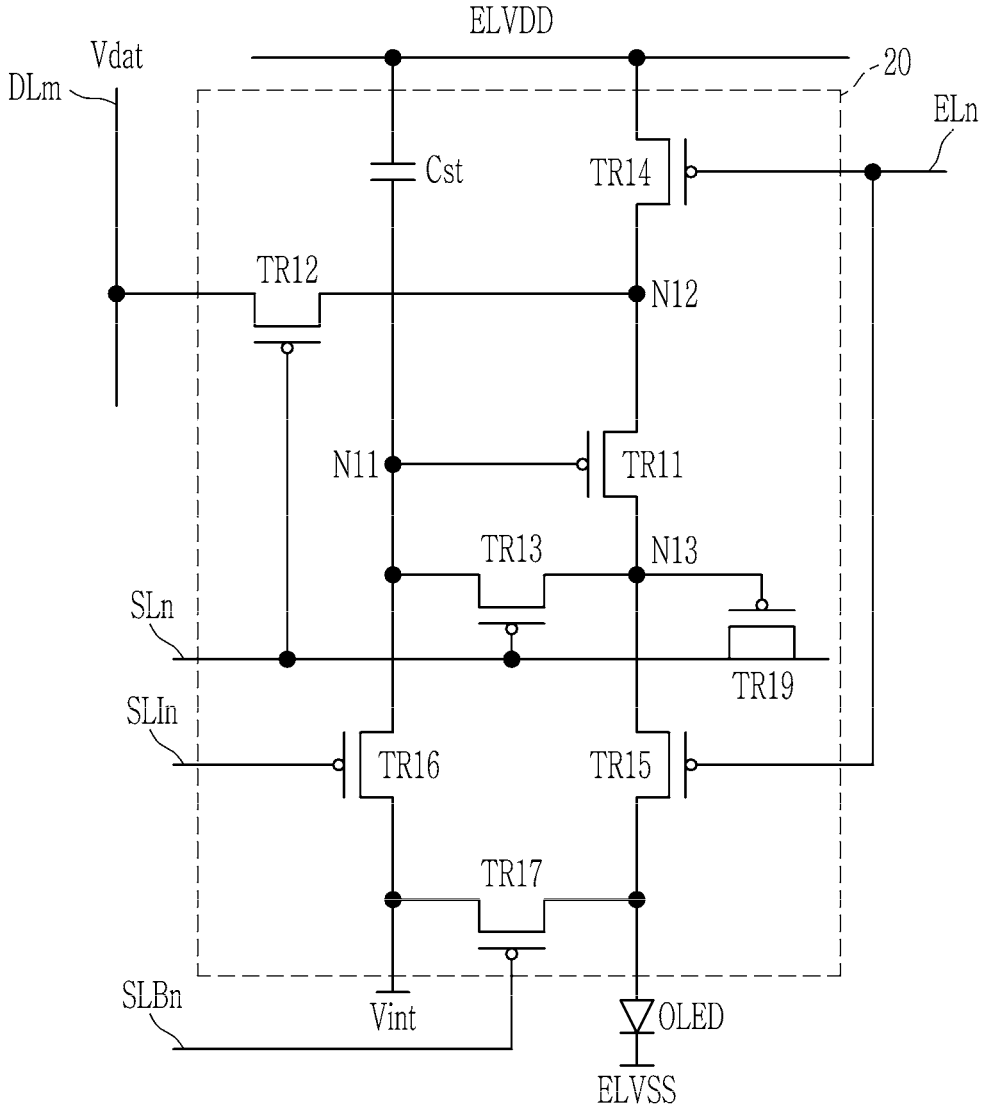
FIG. 4 illustrates a pixel according to an exemplary embodiment.

FIG. 4 illustrates a pixel including a pixel circuit 20 according to an exemplary embodiment.

Compared with FIG. 2, the pixel circuit 20 does not include the first auxiliary transistor TR18, and includes a second auxiliary transistor TR19.

The second auxiliary transistor TR19 includes a gate electrode connected to the third node N13, a first electrode connected to the first gate line SLn, and a second electrode connected to the first gate line SLn. The gate electrode of the second auxiliary transistor TR19 may be connected to the data line DLm through the switching transistor TR12 and the driving transistor TR11. When the compensation transistor TR13 is turned on and the driving transistor TR11 is diode-connected, the compensated data voltage (Vdat+Vth) in which the threshold voltage Vth of the driving transistor TR11 is compensated to the data voltage Vdat may be applied to the gate electrode of the second auxiliary transistor TR19. The second auxiliary transistor TR19 may operate as a MOS capacitor in which the first electrode and the second electrode are electrically connected to each other. The second auxiliary transistor TR19 may be a p-channel field effect transistor.

The second auxiliary transistor TR19 serves to reduce the load of the switching transistor TR12 and the compensation transistor TR13. This will be described with reference to Table 2.

TABLE 2

| | Black | | | Gray | | |
|---|---|---|---|---|---|---|
| | TR12 | TR13 | TR19 | TR12 | TR13 | TR19 |
| Vg | −8 V | −8 V | 3 V | −8 V | −8 V | 1 V |
| Vs (Vd) | 6 V | 3 V | −8 V | 4 V | 1 V | −8 V |
| Vgs | −14 V | −11 V | 11 V | −12 V | −9 V | 9 V |

In Table 2, a case in which the gate-on voltage of the first gate signal is −8 V, the threshold voltage Vth of the driving transistor TR11 is −3 V, the black data voltage is 6 V, and the gray data voltage is 4 V will be exemplarily described.

When the black data voltage is applied to the data line DLm, the gate-source voltage difference Vgs of the switching transistor TR12 is −14 V, and the gate-source voltage difference Vgs of the compensation transistor TR13 is −11 V. The gate voltage Vg of the second auxiliary transistor TR19 is 3 V as the compensated data voltage (Vdat+Vth) in which the threshold voltage Vth of the driving transistor TR11 is compensated to the data voltage Vdat, the source voltage Vs is −8 V, and the gate-source voltage difference Vgs is 11 V.

When the gray data voltage is applied to the data line DLm, the gate-source voltage difference Vgs of the switching transistor TR12 is −12 V, and the gate-source voltage difference Vgs of the compensation transistor TR13 is −9 V. The gate voltage Vg of the second auxiliary transistor TR19 is 1 V as the compensated data voltage (Vdat+Vth) in which the threshold voltage Vth of the driving transistor TR11 is compensated to the data voltage Vdat, the source voltage Vs is −8 V, and the gate-source voltage difference Vgs is 9 V. Like the first auxiliary transistor TR18 described in detail in FIG. 2, the second auxiliary transistor TR19 may reduce the load of the first gate signal applied to the first gate line SLn.

Except for these differences, the features of the exemplary embodiment described above with reference to FIGS. 1, 2, and 3 may be wholly applied to the exemplary embodiment described with reference to FIG. 4, so that redundant descriptions are omitted.

Figure 5:
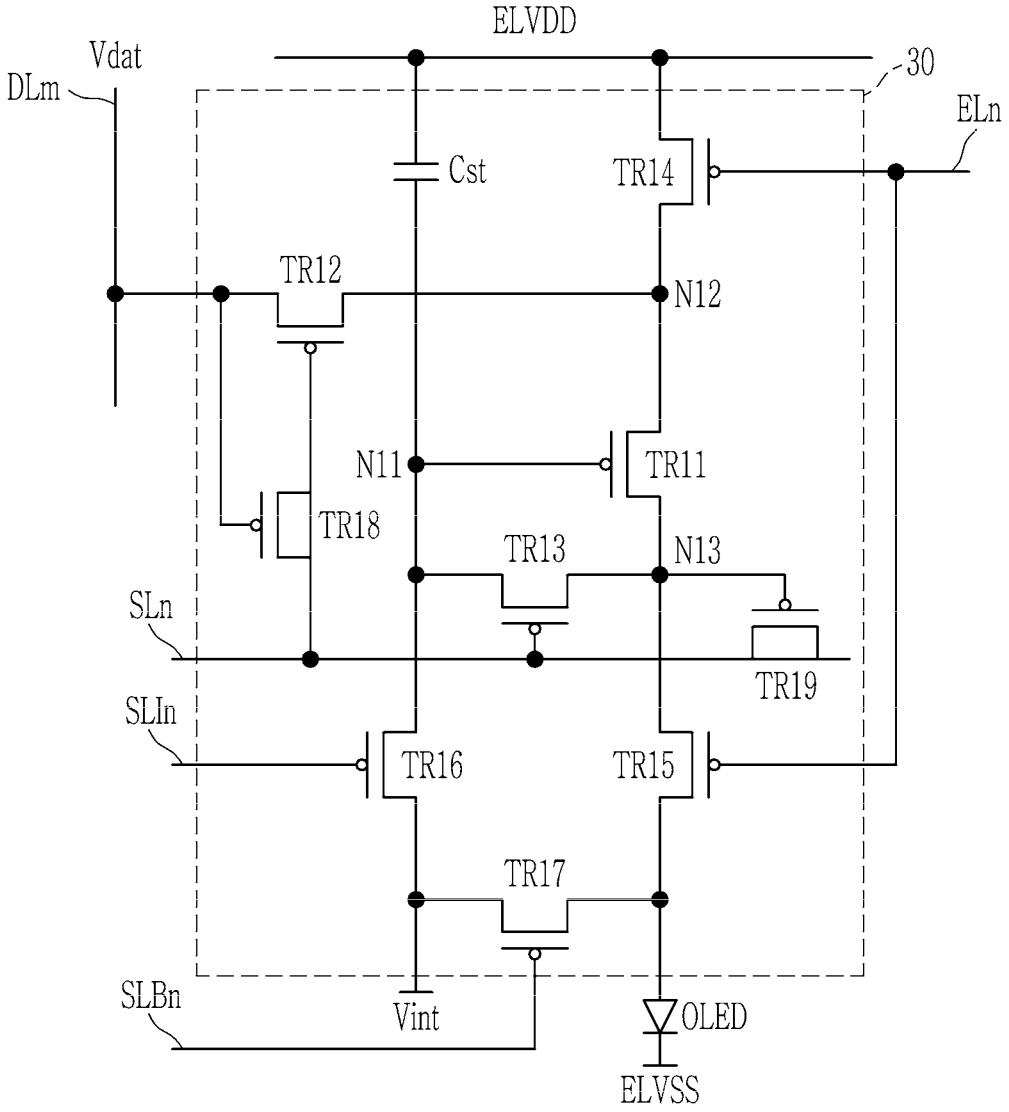
FIG. 5 illustrates a pixel according to an exemplary embodiment.

FIG. 5 illustrates a pixel including a pixel circuit 30 according to an exemplary embodiment.

Compared with FIG. 2 and FIG. 4, the pixel circuit 30 includes the first auxiliary transistor TR18 and the second auxiliary transistor TR19.

As described in detail in FIG. 2, the first auxiliary transistor TR18 may offset the channel capacitance of the switching transistor TR12 and the compensation transistor TR13. In addition, as described in detail in FIG. 4, the second auxiliary transistor TR19 may offset the channel capacitance of the switching transistor TR12 and the compensation transistor TR13.

Except for these differences, the features of the exemplary embodiments described above with reference to FIGS. 1, 2, 3, and 4 may be wholly applied to the exemplary embodiment described with reference to FIG. 5, so that redundant descriptions are omitted.

Figure 6:
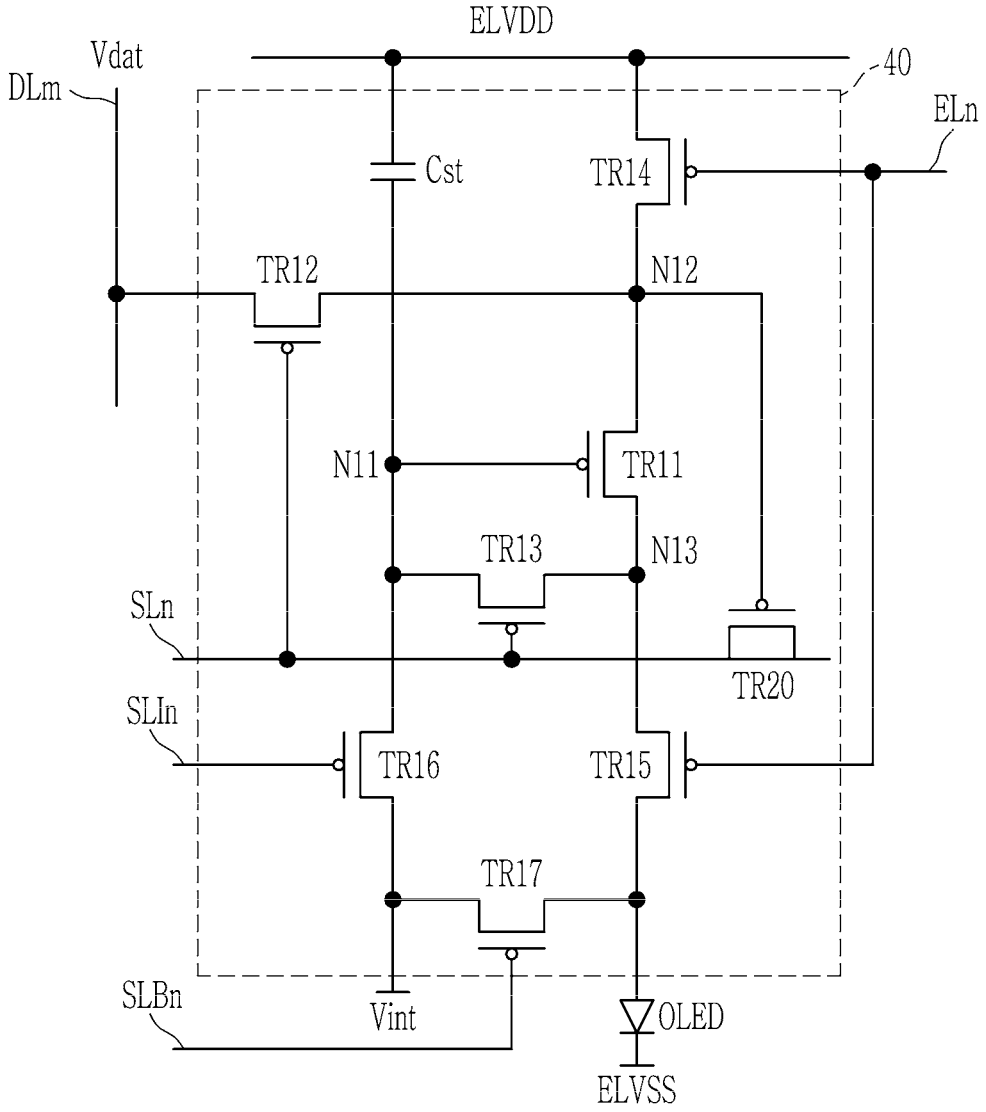
FIG. 6 illustrates a pixel according to an exemplary embodiment.

FIG. 6 illustrates a pixel including a pixel circuit 40 according to an exemplary embodiment.

Compared with FIG. 2 and FIG. 4, the pixel circuit 40 does not include the first auxiliary transistor TR18 and the second auxiliary transistor TR19, and includes a third auxiliary transistor TR20.

The third auxiliary transistor TR20 includes a gate electrode connected to the second node N12, a first electrode connected to the first gate line SLn, and a second electrode connected to the first gate line SLn. The gate electrode of the third auxiliary transistor TR20 may be connected to the data line DLm through the switching transistor TR12. When the switching transistor TR12 is turned on, the data voltage Vdat may be applied to the gate electrode of the third auxiliary transistor TR20. The third auxiliary transistor TR20 may operate as a MOS capacitor in which the first electrode and the second electrode are electrically connected to each other. The third auxiliary transistor TR20 may be a p-channel field effect transistor.

The third auxiliary transistor TR20 serves to reduce the load of the switching transistor TR12 and the compensation transistor TR13. Like the first auxiliary transistor TR18 described with reference to Table 1 and FIG. 2, the third auxiliary transistor TR20 may offset the increased channel capacitance of the switching transistor TR12 and the compensation transistor TR13, and may reduce the load of the first gate signal applied to the first gate line SLn.

Except for these differences, the features of the exemplary embodiment described above with reference to FIGS. 1, 2, and 3 may be wholly applied to the exemplary embodiment described with reference to FIG. 6, so that redundant descriptions are omitted.

Figure 7:
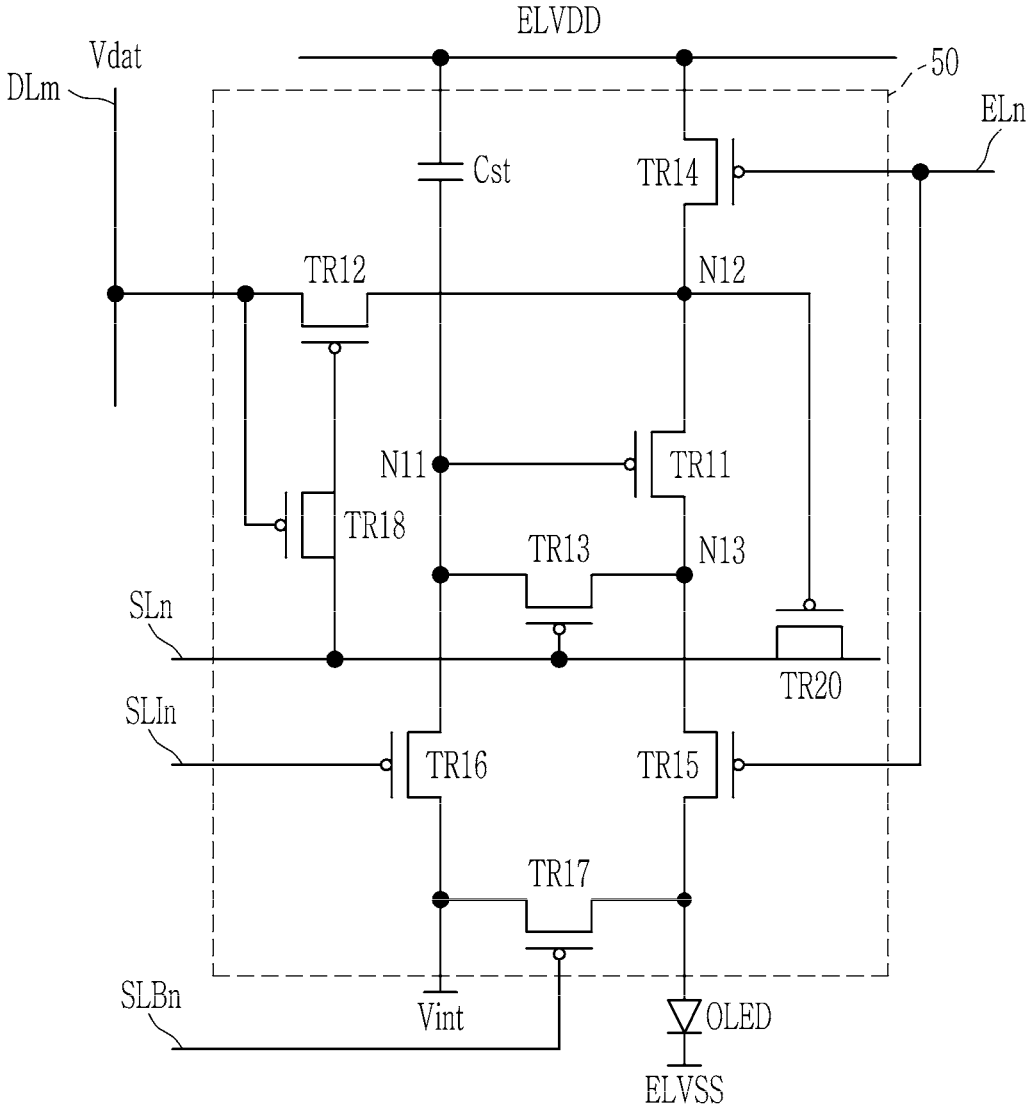
FIG. 7 illustrates a pixel according to an exemplary embodiment.

FIG. 7 illustrates a pixel including a pixel circuit 50 according to an exemplary embodiment.

Compared with FIG. 2, FIG. 4, and FIG. 6, the pixel circuit 50 does not include the second auxiliary transistor TR19, and includes the first auxiliary transistor TR18 and the third auxiliary transistor TR20.

The first auxiliary transistor TR18 and the third auxiliary transistor TR20 may offset the increased channel capacitance of the switching transistor TR12 and the compensation transistor TR13, and may reduce the load of the first gate signal applied to the first gate line SLn.

Except for these differences, the features of the exemplary embodiments described above with reference to FIGS. 1, 2, and 3 and FIG. 6 may be wholly applied to the exemplary embodiment described with reference to FIG. 7, so that redundant descriptions are omitted.

Figure 8:
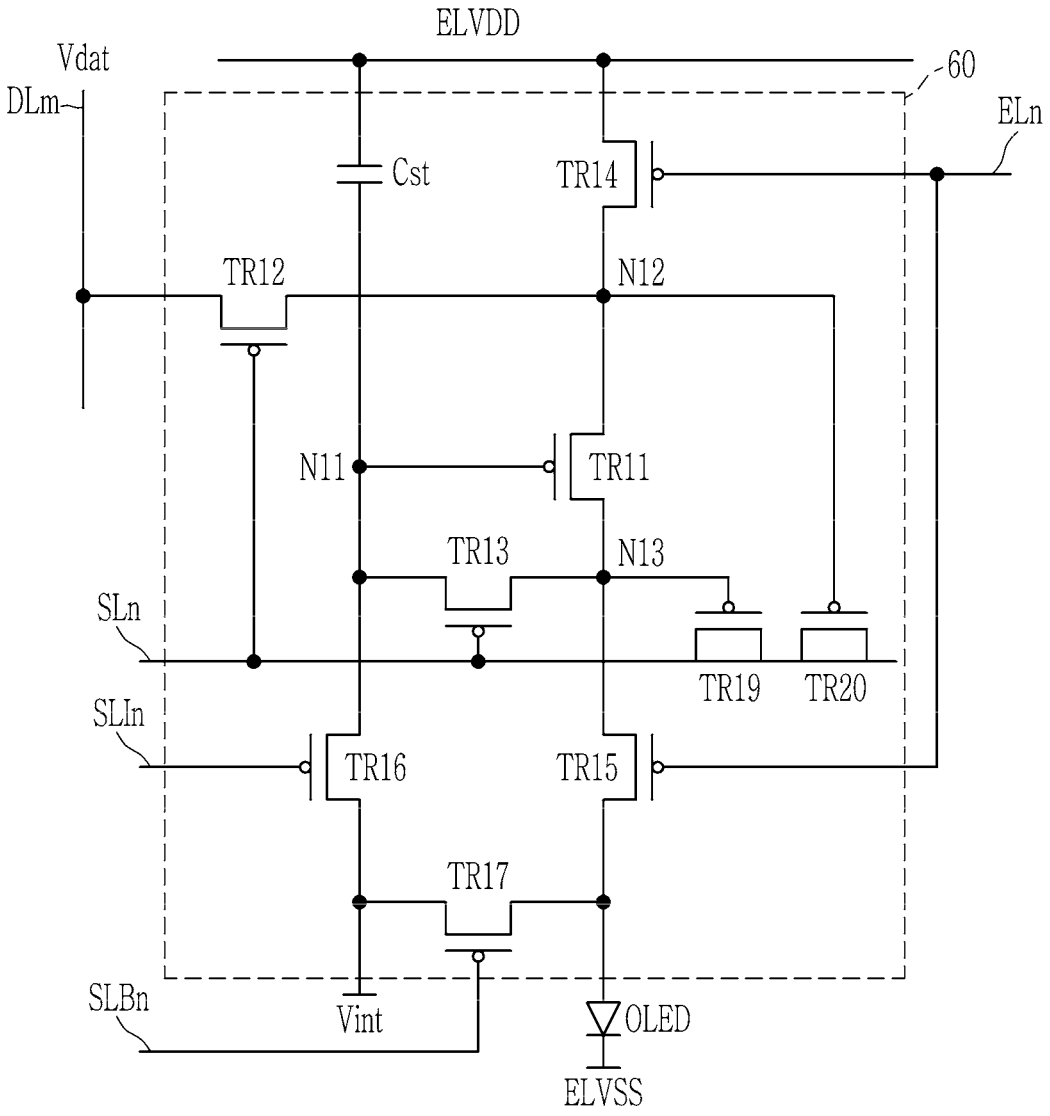
FIG. 8 illustrates a pixel according to an exemplary embodiment.

FIG. 8 illustrates a pixel including a pixel circuit 60 according to an exemplary embodiment.

Compared with FIG. 2, FIG. 4, and FIG. 6, the pixel circuit 60 does not include the first auxiliary transistor TR18, and includes the second auxiliary transistor TR19 and the third auxiliary transistor TR20.

The second auxiliary transistor TR19 and the third auxiliary transistor TR20 may offset the increased channel capacitance of the switching transistor TR12 and the compensation transistor TR13, and may reduce the load of the first gate signal applied to the first gate line SLn.

Except for these differences, the features of the exemplary embodiments described above with reference to FIGS. 1, 2, 3, 4 and 6 may be wholly applied to the exemplary embodiment described with reference to FIG. 8, so that redundant descriptions are omitted.

Figure 9:
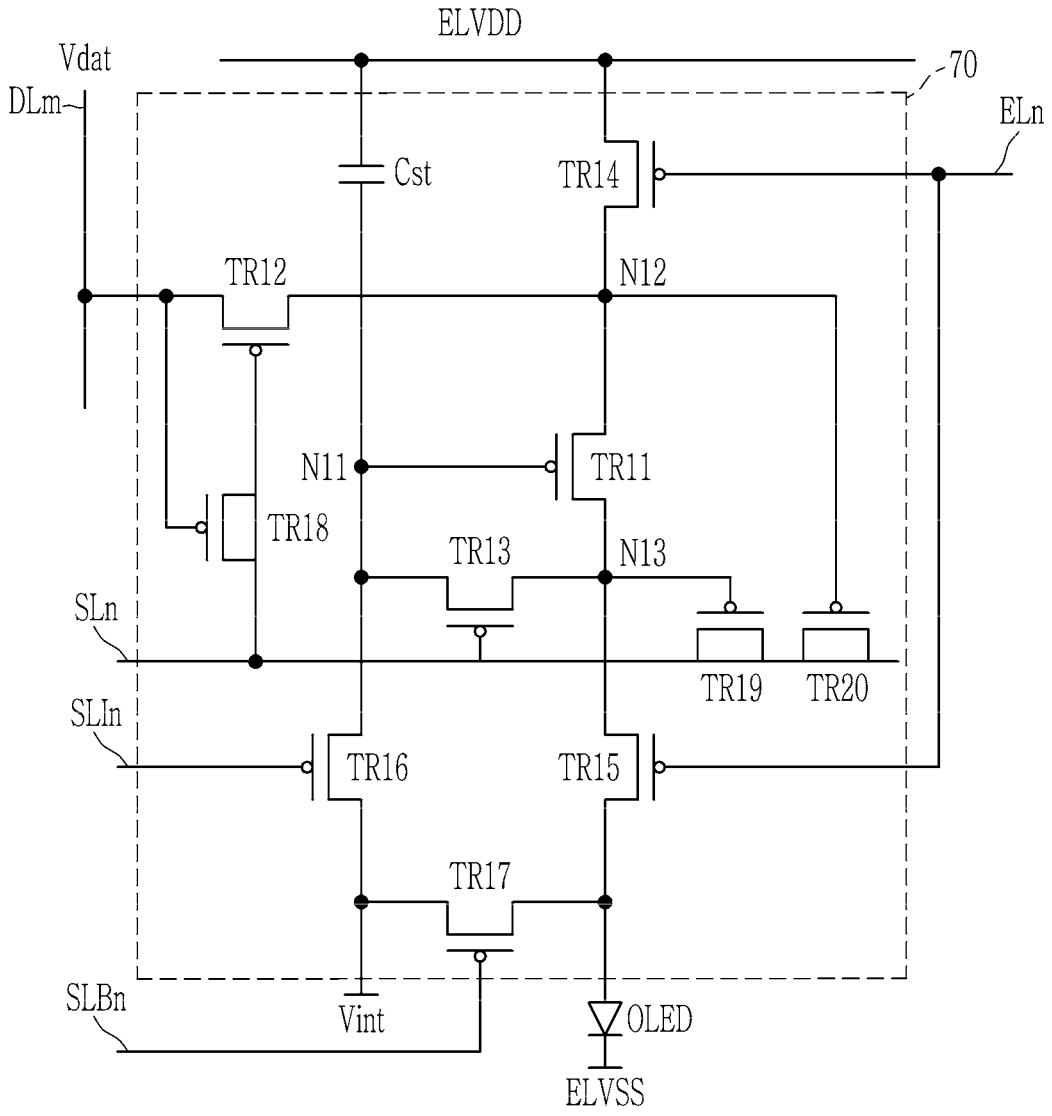
FIG. 9 illustrates a pixel according to an exemplary embodiment.

FIG. 9 illustrates a pixel including a pixel circuit 70 according to an exemplary embodiment.

Compared with FIG. 2, FIG. 4, and FIG. 6, the pixel circuit 70 includes the first auxiliary transistor TR18, the second auxiliary transistor TR19, and the third auxiliary transistor TR20.

The first auxiliary transistor TR18, the second auxiliary transistor TR19, and the third auxiliary transistor TR20 may offset the increased channel capacitance of the switching transistor TR12 and the compensation transistor TR13, and may reduce the load of the first gate signal applied to the first gate line SLn.

Except for these differences, the features of the exemplary embodiments described above with reference to FIGS. 1, 2, 3, 4 and 6 may be wholly applied to the exemplary embodiment described with reference to FIG. 9, so that redundant descriptions are omitted.

Figure 10:
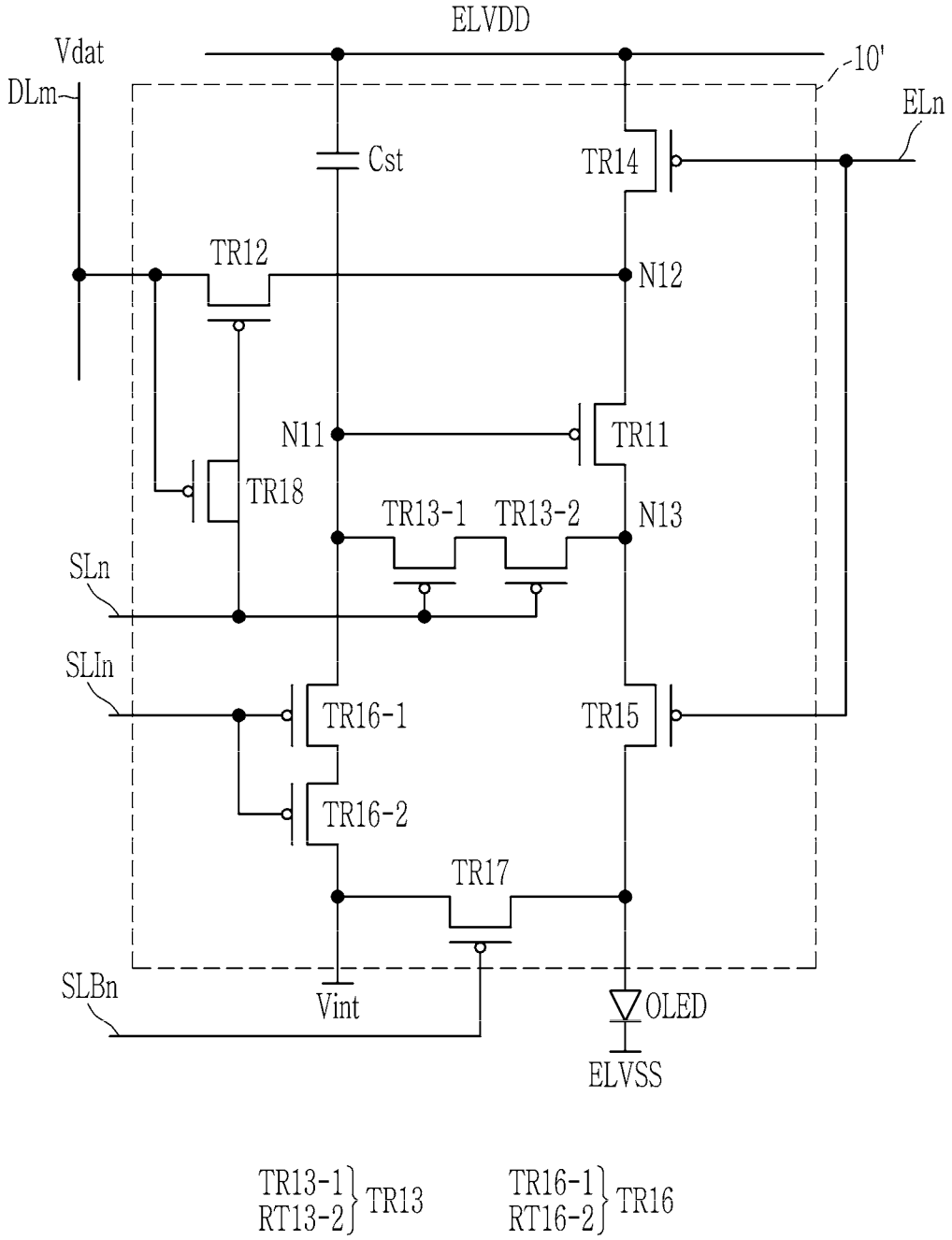
FIG. 10 illustrates a pixel according to an exemplary embodiment.

FIG. 10 illustrates a pixel including a pixel circuit 10' according to an exemplary embodiment.

Compared with FIG. 2, in the pixel circuit 10', the compensation transistor TR13 includes a first compensation transistor TR13-1 and a second compensation transistor TR13-2, and the initialization transistor TR16 includes a first initialization transistor TR16-1 and a second initialization transistor TR16-2.

The first compensation transistor TR13-1 includes a gate electrode connected to the first gate line SLn, a first electrode connected to a second electrode of the second compensation transistor TR13-2, and a second electrode connected to the first node N11. The second compensation transistor TR13-2 includes a gate electrode connected to the first gate line SLn, a first electrode connected to the third node N13, and a second electrode connected to the first electrode of the first compensation transistor TR13-1. That is, the compensation transistor TR13 may be formed with the first compensation transistor TR13-1 and the second compensation transistor TR13-2 connected in series between the first node N11 and the third node N13. Since the compensation transistor TR13 is formed with a plurality of transistors connected in series to the first node N11 and the third node N13, it is possible to securely block a leakage current that may flow between the first node N11 and the third node N13.

The first initialization transistor TR16-1 includes a gate electrode connected to the second gate line SLIn, a first electrode connected to the second electrode of the second initialization transistor TR16-2, and a second electrode connected to the first node N11. The second initialization transistor TR16-2 includes a gate electrode connected to the second gate line SLIn, a first electrode connected to the initialization voltage Vint, and a second electrode connected to the first electrode of the first initialization transistor TR16-1. That is, the initialization transistor TR16 may be formed with the first initialization transistor TR16-1 and the second initialization transistor TR16-2 connected in series between the first node N11 and the initialization voltage Vint. Since the initialization transistor TR16 is formed with a plurality of transistors connected in series between the first node N11 and the initialization voltage Vint, it is possible to securely block a leakage current that may flow between the first node N11 and the initialization voltage Vint.

Compared with the case in which the compensation transistor TR13 is formed with one transistor as in FIG. 2, since the compensation transistor TR13 is formed with the first compensation transistor TR13-1 and the second compensation transistor TR13-2 as in FIG. 10, when the black data voltage is applied, the channel capacitance of the compensation transistor TR13 may be further increased compared to the case of FIG. 2, due to the first compensation transistor TR13-1 and the second compensation transistor TR13-2.

Even in this case, the channel capacitance of the first auxiliary transistor TR18 may offset the increased channel capacitance of the switching transistor TR12, the first compensation transistor TR13-1, and the second compensation transistor TR13-2.

Except for these differences, the features of the exemplary embodiment described above with reference to FIGS. 1, 2, and 3 may be wholly applied to the exemplary embodiment described with reference to FIG. 10, so that redundant descriptions are omitted.

Figure 11:
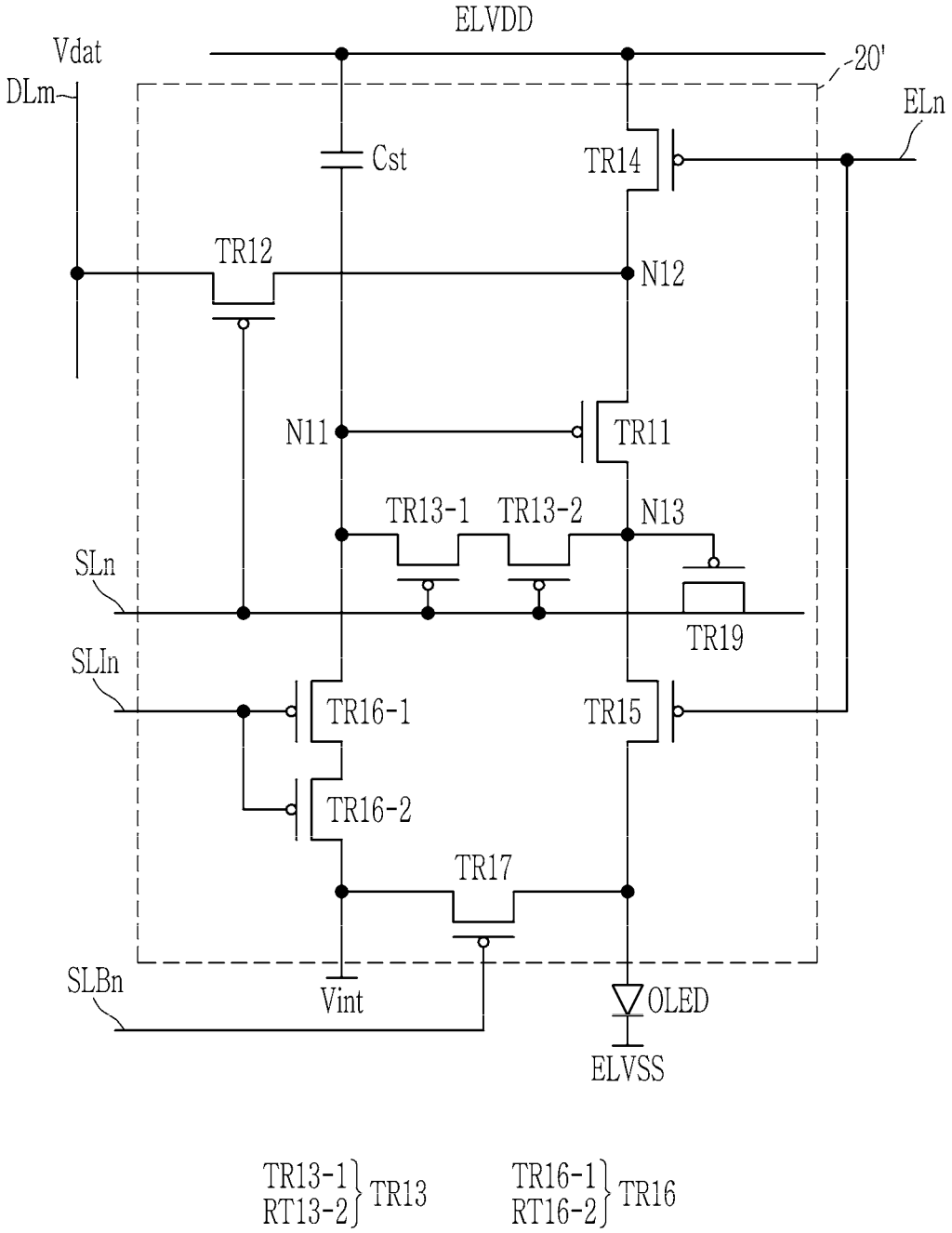
FIG. 11 illustrates a pixel according to an exemplary embodiment.

FIG. 11 illustrates a pixel including a pixel circuit 20' according to an exemplary embodiment.

Compared with FIG. 4, in the pixel circuit 20', the compensation transistor TR13 includes the first compensation transistor TR13-1 and the second compensation transistor TR13-2, and the initialization transistor TR16 includes the first initialization transistor TR16-1 and the second initialization transistor TR16-2.

When the black data voltage is applied, even in a case in which the channel capacitance of the compensation transistor TR13 is further increased due to the first compensation transistor TR13-1 and the second compensation transistor TR13-2, the channel capacitance of the second auxiliary transistor TR19 may offset the increased channel capacitance of the switching transistor TR12, the first compensation transistor TR13-1, and the second compensation transistor TR13-2.

Except for these differences, the features of the exemplary embodiments described above with reference to FIGS. 1, 2, 3, 4, and 10 may be wholly applied to the exemplary embodiment described with reference to FIG. 11, so that redundant descriptions are omitted.

Figure 12:
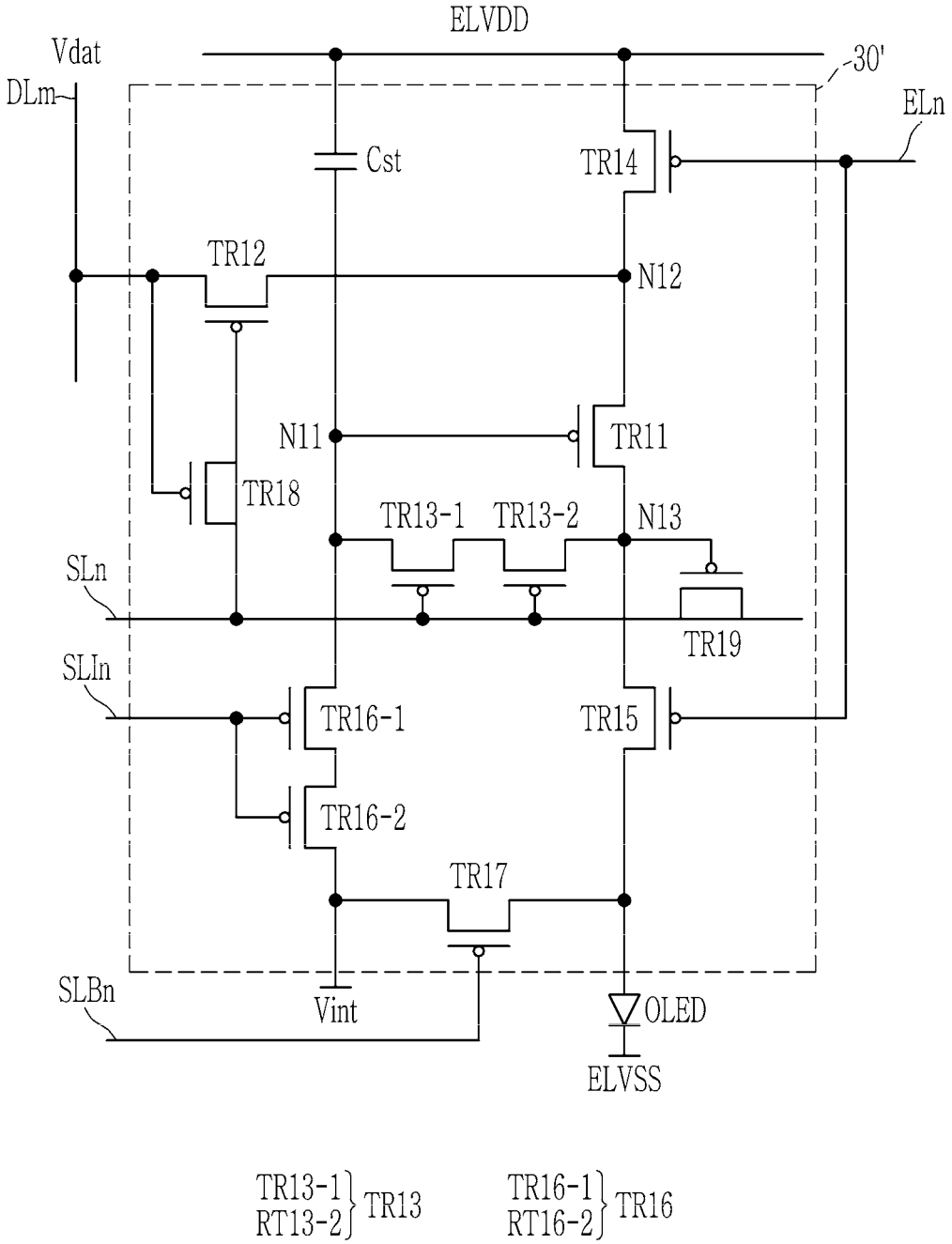
FIG. 12 illustrates a pixel according to an exemplary embodiment.

FIG. 12 illustrates a pixel including a pixel circuit 30' according to an exemplary embodiment.

Compared with FIG. 5, in the pixel circuit 30', the compensation transistor TR13 includes the first compensation transistor TR13-1 and the second compensation transistor TR13-2, and the initialization transistor TR16 includes the first initialization transistor TR16-1 and the second initialization transistor TR16-2.

When the black data voltage is applied, even in a case in which the channel capacitance of the compensation transistor TR13 is further increased due to the first compensation transistor TR13-1 and the second compensation transistor TR13-2, the channel capacitance of the first auxiliary transistor TR18 and the second auxiliary transistor TR19 may offset the increased channel capacitance of the switching transistor TR12, the first compensation transistor TR13-1, and the second compensation transistor TR13-2.

Except for these differences, the features of the exemplary embodiments described above with reference to FIGS. 1, 2, 3, 5, and 10 may be wholly applied to the exemplary embodiment described with reference to FIG. 12, so that redundant descriptions are omitted.

Figure 13:
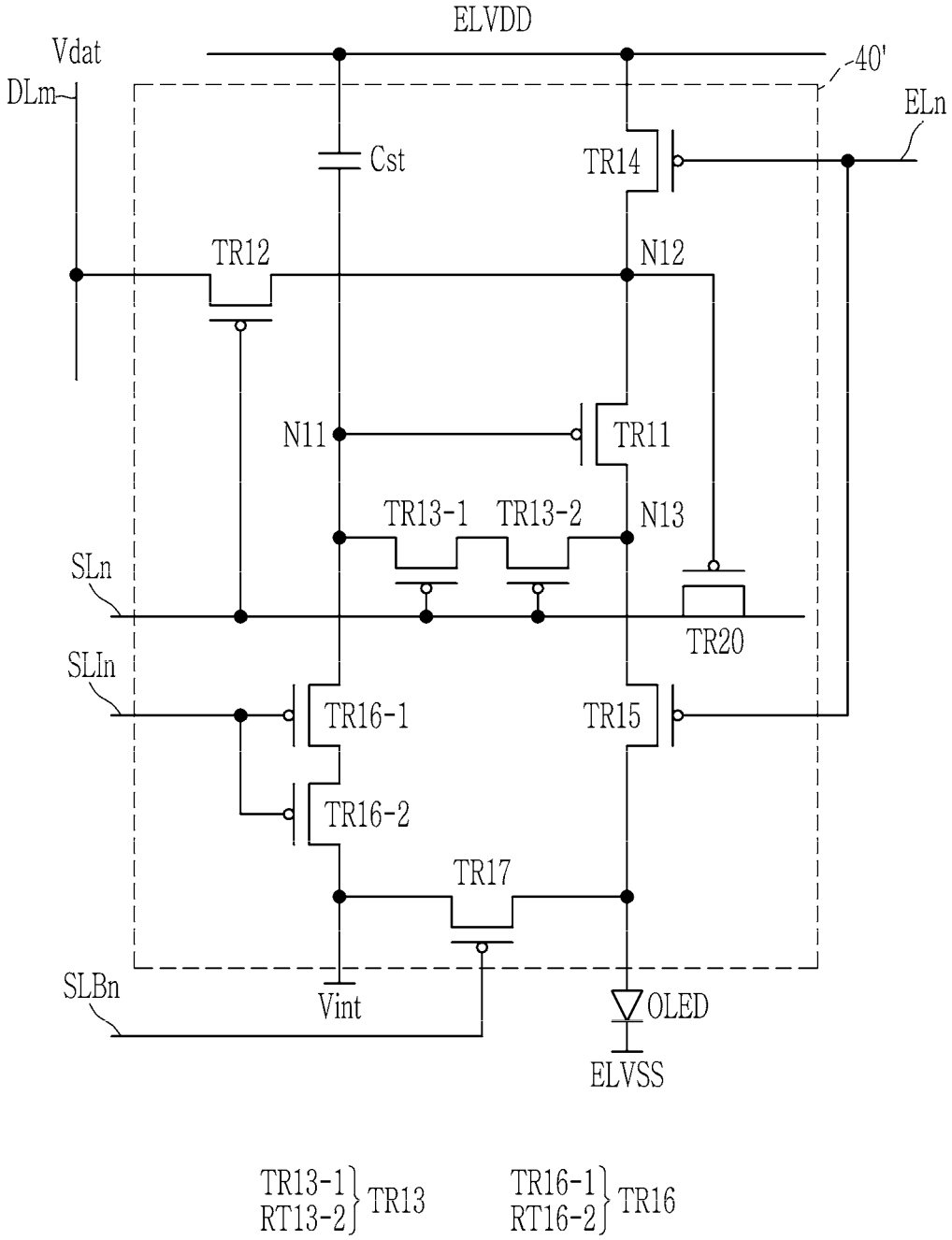
FIG. 13 illustrates a pixel according to an exemplary embodiment.

FIG. 13 illustrates a pixel including a pixel circuit 40' according to an exemplary embodiment.

Compared with FIG. 6, in the pixel circuit 40', the compensation transistor TR13 includes the first compensation transistor TR13-1 and the second compensation transistor TR13-2, and the initialization transistor TR16 includes the first initialization transistor TR16-1 and the second initialization transistor TR16-2.

When the black data voltage is applied, even in a case in which the channel capacitance of the compensation transistor TR13 is further increased due to the first compensation transistor TR13-1 and the second compensation transistor TR13-2, the channel capacitance of the third auxiliary transistor TR20 may offset the increased channel capacitance of the switching transistor TR12, the first compensation transistor TR13-1, and the second compensation transistor TR13-2.

Except for these differences, the features of the exemplary embodiments described above with reference to FIGS. 1, 2, 3, 6, and 10 may be wholly applied to the exemplary embodiment described with reference to FIG. 13, so that redundant descriptions are omitted.

Figure 14:
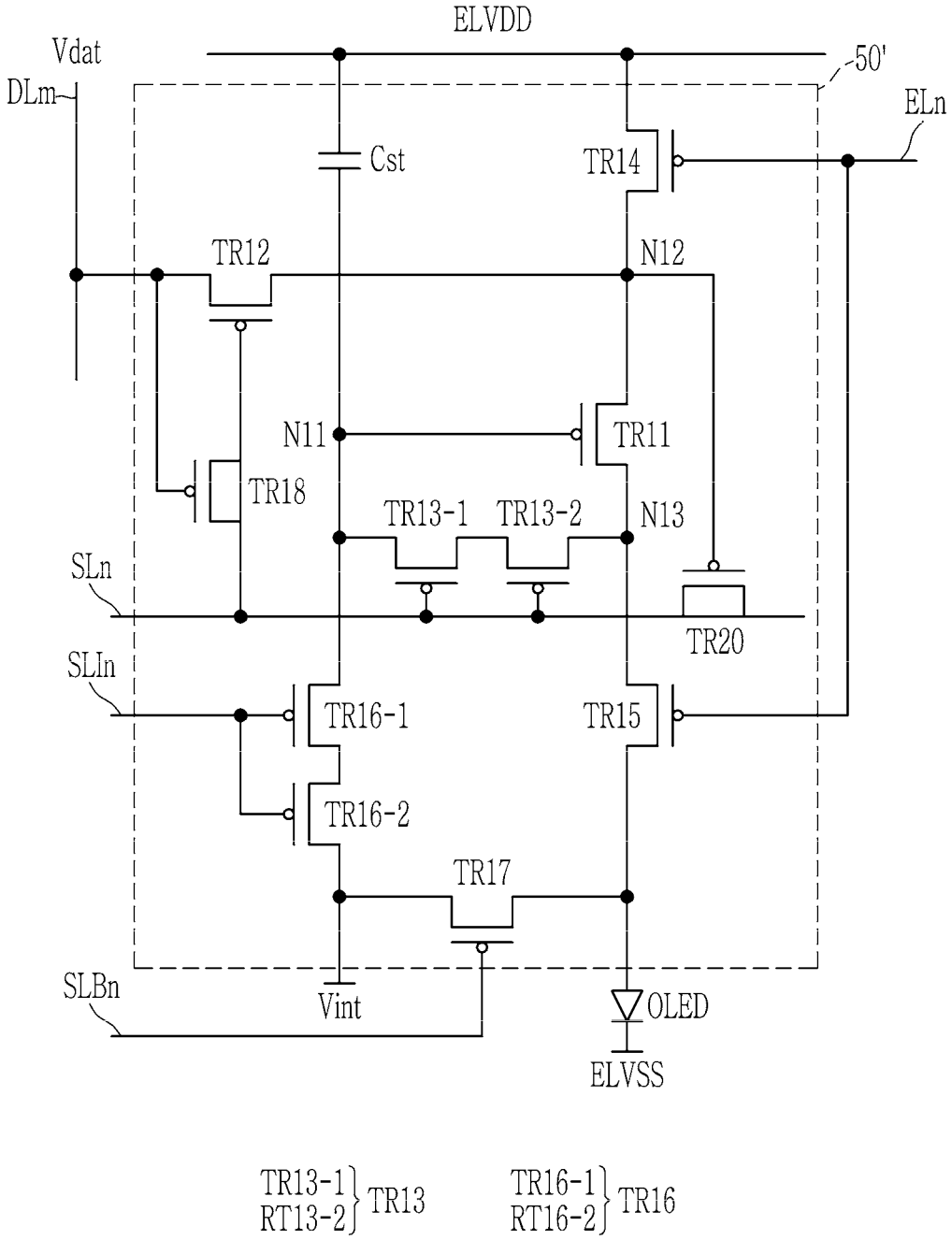
FIG. 14 illustrates a pixel according to an exemplary embodiment.

FIG. 14 illustrates a pixel including a pixel circuit 50' according to an exemplary embodiment.

Compared with FIG. 7, in the pixel circuit 50', the compensation transistor TR13 includes the first compensation transistor TR13-1 and the second compensation transistor TR13-2, and the initialization transistor TR16 includes the first initialization transistor TR16-1 and the second initialization transistor TR16-2.

When the black data voltage is applied, even in a case in which the channel capacitance of the compensation transistor TR13 is further increased due to the first compensation transistor TR13-1 and the second compensation transistor TR13-2, the channel capacitance of the first auxiliary transistor TR18 and the third auxiliary transistor TR20 may offset the increased channel capacitance of the switching transistor TR12, the first compensation transistor TR13-1, and the second compensation transistor TR13-2.

Except for these differences, the features of the exemplary embodiments described above with reference to FIGS. 1, 2, 3, 7, and 10 may be wholly applied to the exemplary embodiment described with reference to FIG. 14, so that redundant descriptions are omitted.

Figure 15:
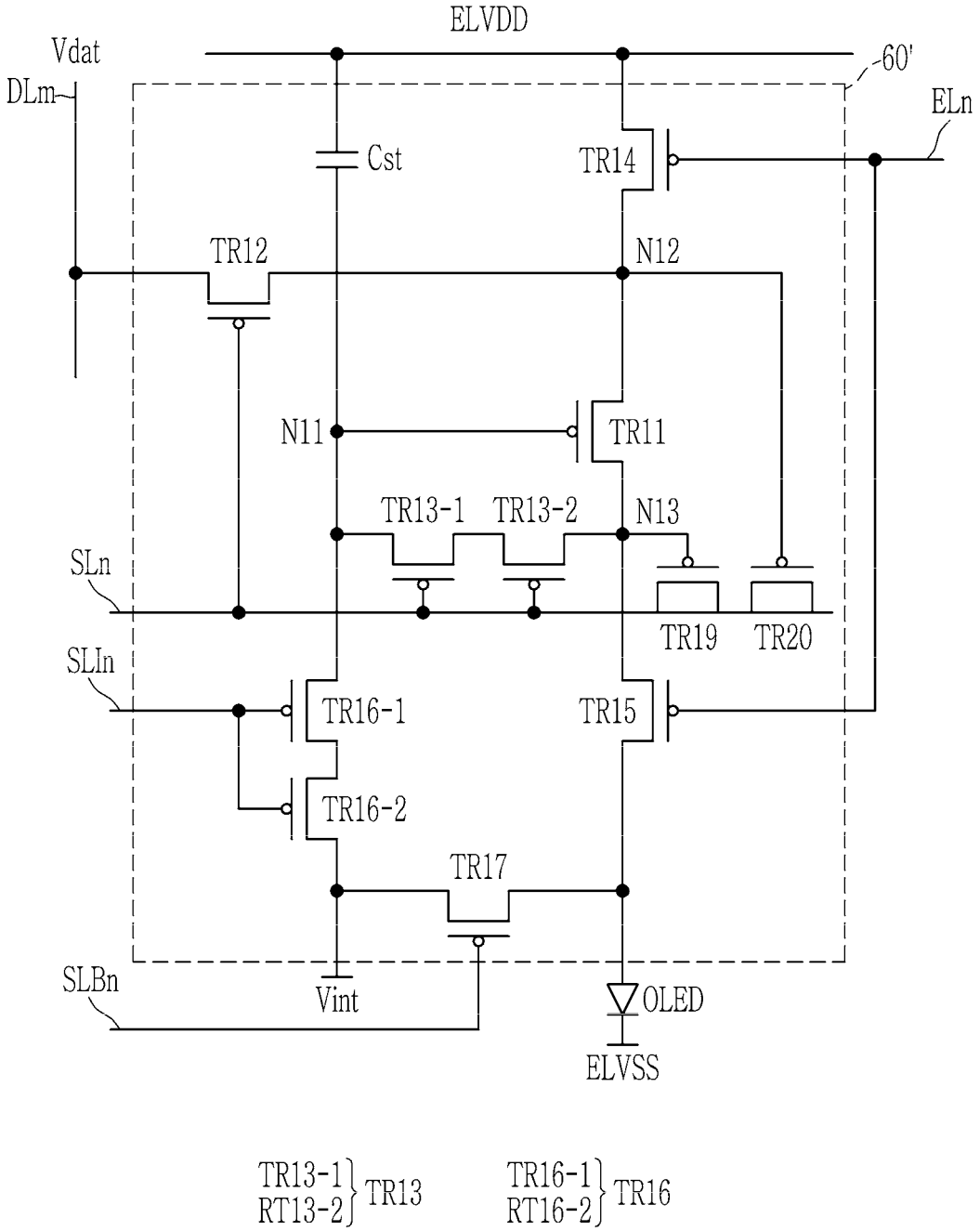
FIG. 15 illustrates a pixel according to an exemplary embodiment.

FIG. 15 illustrates a pixel including a pixel circuit 60' according to an exemplary embodiment.

Compared with FIG. 8, in the pixel circuit 60', the compensation transistor TR13 includes the first compensation transistor TR13-1 and the second compensation transistor TR13-2, and the initialization transistor TR16 includes the first initialization transistor TR16-1 and the second initialization transistor TR16-2.

When the black data voltage is applied, even in a case in which the channel capacitance of the compensation transistor TR13 is further increased due to the first compensation transistor TR13-1 and the second compensation transistor TR13-2, the channel capacitance of the second auxiliary transistor TR19 and the third auxiliary transistor TR20 may offset the increased channel capacitance of the switching transistor TR12, the first compensation transistor TR13-1, and the second compensation transistor TR13-2.

Except for these differences, the features of the exemplary embodiments described above with reference to FIGS. 1, 2, 3, 8, and 10 may be wholly applied to the exemplary embodiment described with reference to FIG. 15, so that redundant descriptions are omitted.

Figure 16:
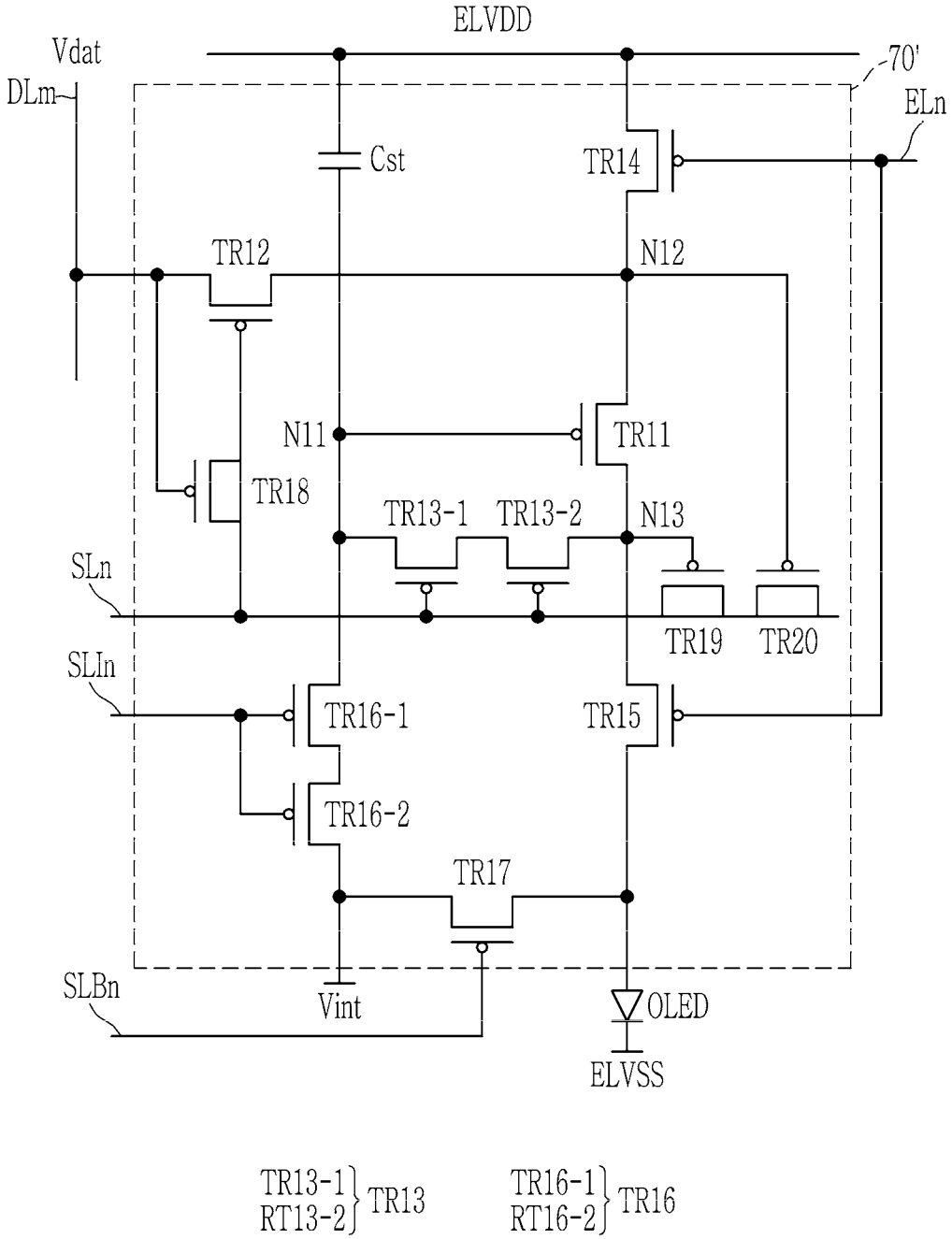
FIG. 16 illustrates a pixel according to an exemplary embodiment.

FIG. 16 illustrates a pixel including a pixel circuit 70' according to an exemplary embodiment.

Compared with FIG. 9, in the pixel circuit 70', the compensation transistor TR13 includes the first compensation transistor TR13-1 and the second compensation transistor TR13-2, and the initialization transistor TR16 includes the first initialization transistor TR16-1 and the second initialization transistor TR16-2.

When the black data voltage is applied, even in a case in which the channel capacitance of the compensation transistor TR13 is further increased due to the first compensation transistor TR13-1 and the second compensation transistor TR13-2, the channel capacitance of the first auxiliary transistor TR18, the second auxiliary transistor TR19, and the third auxiliary transistor TR20 may offset the increased channel capacitance of the switching transistor TR12, the first compensation transistor TR13-1, and the second compensation transistor TR13-2.

Except for these differences, the features of the exemplary embodiments described above with reference to FIGS. 1, 2, 3, 9, and 10 may be wholly applied to the exemplary embodiment described with reference to FIG. 16, so that redundant descriptions are omitted.

Hereinafter, a driving method of a display device will be exemplarily described with reference to FIG. 17.

Figure 17:
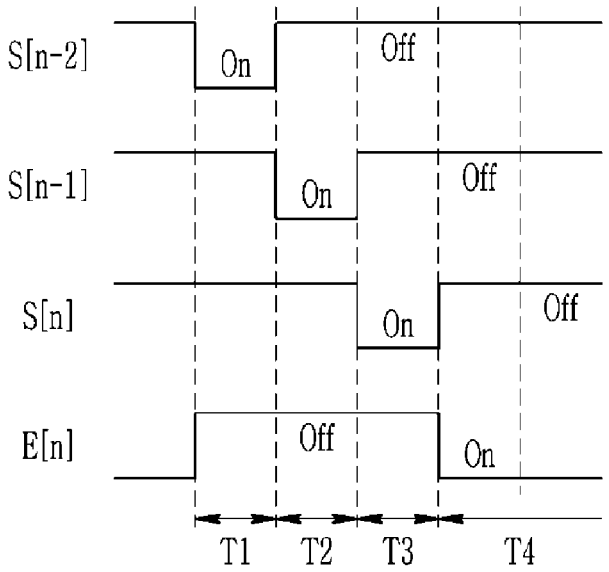
FIG. 17 illustrates a timing chart of a driving method of a display device according to an exemplary embodiment.

FIG. 17 illustrates a timing chart of a driving method of a display device according to an exemplary embodiment.

Referring to FIG. 17, a driving method of the display device according to an exemplary embodiment may include a reset period T1, an initialization period T2, a data write period T3, and an emission period T4. According to the exemplary embodiment, the pixel positioned at an n-th row includes the first gate line SLn, the second gate line SLIn connected to the gate line SLn−1 of the pixel on a previous row, which is the n−1 row, and the third gate line SLBn connected to the gate line SLn−2 of a pixel on the n−2 row.

During the reset period T1, a third gate signal S[n−2] of a gate-on voltage On is applied to the third gate line SLBn. In this case, a first gate signal S[n] applied to the first gate line SLn, a second gate signal S[n−1] applied to the second gate line SLIn, and an emission control signal E[n] applied to the emission control line ELn are applied as a gate-off voltage Off. The reset transistor TR17 is turned on by the third gate signal S[n−2] of the gate-on voltage On, and the initialization voltage Vint is transmitted to the anode of the organic light emitting diode (OLED). The organic light emitting diode (OLED) may be reset by the initialization voltage Vint.

During the initialization period T2, the second gate signal S[n−1] is applied as a gate-on voltage On. In this case, the first gate signal S[n], the third gate signal S[n−2], and the emission control signal E[n] are applied as a gate-off voltage Off. The initialization transistor TR16 is turned on by the second gate signal S[n−l] of the gate-on voltage On, and the initialization voltage Vint is transmitted to the first node N11. The gate voltage of the driving transistor TR11 may be initialized by the initialization voltage Vint.

During the data write period T3, the first gate signal S[n] is applied as a gate-on voltage On. In this case, the second gate signal S[n−1], the third gate signal S[n−2], and the emission control signal E[n] are applied as a gate-off voltage Off. The switching transistor TR12 and the compensation transistor TR13 are turned on by the first gate signal S[n] of the gate-on voltage On. The data voltage Vdat is transmitted to the second node N12 through the turned on switching transistor TR12. As the compensation transistor TR13 is turned on, the driving transistor TR11 is diode-connected, and the compensated data voltage (Vdat+Vth) in which the threshold voltage Vth of the driving transistor TR11 is compensated to the data voltage Vdat is transmitted to the first node N11. The voltage (Vdat+Vth) transmitted to the first node N11 may be maintained by the storage capacitor Cst. In the case of the pixel circuits 10, 30, 50, 70, 10', 30', 50', and 70' of FIG. 2, FIG. 5, FIG. 7, FIG. 9, FIG. 10, FIG. 12, FIG. 14, and FIG. 16 including the first auxiliary transistor TR18, the first auxiliary transistor TR18 may operate as a MOS capacitor for offsetting the channel capacitance of the switching transistor TR12 and the compensation transistor TR13. In the case of the pixel circuits 20, 30, 60, 70, 20', 30', 60', and 70' of FIG. 4, FIG. 5, FIG. 8, FIG. 9, FIG. 11, FIG. 12, FIG. 15, and FIG. 16 including the second auxiliary transistor TR19, the second auxiliary transistor TR19 may operate as a MOS capacitor for offsetting the channel capacitance of the switching transistor TR12 and the compensation transistor TR13. In the case of the pixel circuits 40, 50, 60, 70, 40', 50', 60', and 70' of FIG. 6, FIG. 7, FIG. 8, FIG. 9, FIG. 13, FIG. 14, FIG. 15, and FIG. 16 including the third auxiliary transistor TR20, the third auxiliary transistor TR20 may operate as a MOS capacitor for offsetting the channel capacitance of the switching transistor TR12 and the compensation transistor TR13.

During the emission period T4, the emission control signal E[n] is applied as a gate-on voltage On. In this case, the first gate signal S[n], the second gate signal S[n−1], and the third gate signal S[n−2] are applied as a gate-off voltage Off. The first emission control transistor TR14 and the second emission control transistor TR15 are turned on by the emission control signal E[n] of the gate-on voltage On. The first power voltage ELVDD is transmitted to the second node N12 through the turned on first emission control transistor TR14, and the driving transistor TR11 and the organic light emitting diode (OLED) may be electrically connected by the turned on second emission control transistor TR15. A current corresponding to the voltage (Vdat+Vth) of the first node N11 flows from the first power voltage ELVDD to the organic light emitting diode (OLED) through the driving transistor TR11, and the organic light emitting diode (OLED) may emit light with a luminance corresponding to an amount of the current.

According to the exemplary embodiments of the present invention, a pixel circuit includes a compensation transistor to reduce load of a gate signal and to prevent or reduce crosstalk of a display device by offsetting channel capacitance of a switching transistor and channel capacitance of a compensation transistor by providing an auxiliary transistor.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a pixel; and a gate line and a data line connected to the pixel, wherein the pixel comprises:

a driving transistor comprising a gate electrode connected to a first node, a first electrode connected to a second node, and a second electrode connected to a third node;

a switching transistor comprising a gate electrode connected to the gate line, a first electrode connected to the data line, and a second electrode connected to the second node;

a compensation transistor comprising a gate electrode connected to the gate line, a first electrode connected to the third node, and a second electrode connected to the first node;

an auxiliary transistor including a gate electrode connected to the data line, a first electrode connected to the gate line, and a second electrode connected to the gate line; and an organic light emitting diode (OLED) connected to the third node, wherein the auxiliary transistor offsets channel capacitance of the compensation transistor.

2. The display device of claim 1, wherein the gate electrode of the auxiliary transistor is directly connected to the data line.

3. The display device of claim 2, wherein a data voltage applied to the data line is directly applied to the gate electrode of the auxiliary transistor, a gate-on voltage of a gate signal is applied to the gate line, and the channel capacitance of the compensation transistor is offset.

4. The display device of claim 1, wherein the gate electrode of the auxiliary transistor is connected to the data line through the switching transistor and the driving transistor.

5. The display device of claim 4, wherein a data voltage in which a threshold voltage of the driving transistor is compensated is applied to the gate electrode of the auxiliary transistor.

6. The display device of claim 1, wherein the gate electrode of the auxiliary transistor is connected to the data line through the switching transistor.

7. The display device of claim 6, wherein a data voltage applied to the data line is applied to the gate electrode of the auxiliary transistor through the switching transistor, a gate-on voltage of a gate signal is applied to the gate line, and the channel capacitance of the compensation transistor is offset.

8. The display device of claim 1, wherein the compensation transistor diode-connects the driving transistor in response to a gate-on voltage of a gate signal applied to the gate line.

* * * * *